US009311893B2

(12) United States Patent
Kwon et al.

(10) Patent No.: US 9,311,893 B2
(45) Date of Patent: Apr. 12, 2016

(54) DISPLAY DEVICE

(71) Applicant: Samsung Display Co. Ltd., Yongin, Gyeonggi-Do (KR)

(72) Inventors: Yong Hoon Kwon, Hwaseong-si (KR); Hee Kwang Song, Suwon-si (KR); Ho Sik Shin, Gunpo-si (KR); Jung Hyun Kim, Seoul (KR); Seok Hyun Nam, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 114 days.

(21) Appl. No.: 14/306,510

(22) Filed: Jun. 17, 2014

(65) Prior Publication Data

US 2015/0206507 A1 Jul. 23, 2015

(30) Foreign Application Priority Data

Jan. 22, 2014 (KR) ..... 10-2014-0007802

(51) Int. Cl.

| | |
|---|---|
| ***G09G 3/36*** | (2006.01) |
| ***G09G 5/10*** | (2006.01) |
| ***G09G 5/02*** | (2006.01) |
| *G09G 3/34* | (2006.01) |

(52) U.S. Cl.

CPC .. *G09G 5/10* (2013.01); *G09G 3/36* (2013.01); *G09G 5/02* (2013.01); *G09G 3/3426* (2013.01)

(58) Field of Classification Search

CPC ..... G09G 3/3426

See application file for complete search history.

(56) References Cited

U.S. PATENT DOCUMENTS

| | | | | |
|---|---|---|---|---|
| 7,430,022 | B2 | 9/2008 | Hekstra et al. | |
| 7,609,240 | B2 * | 10/2009 | Park | H05B 33/086 345/82 |
| 7,714,497 | B2 | 5/2010 | Haga et al. | |
| 7,782,283 | B2 | 8/2010 | Hong et al. | |
| 8,026,893 | B2 | 9/2011 | Hong et al. | |
| 8,054,408 | B2 | 11/2011 | Hsu et al. | |
| 8,648,886 | B2 * | 2/2014 | Baek | G09G 3/3413 345/690 |
| 2008/0128735 | A1 * | 6/2008 | Yoo | C09K 11/0883 257/98 |
| 2008/0203929 | A1 * | 8/2008 | Park | H05B 33/086 315/158 |
| 2010/0141155 | A1 * | 6/2010 | Hong | G09G 3/3413 315/152 |
| 2010/0156959 | A1 | 6/2010 | Tanahashi | |
| 2011/0025731 | A1 | 2/2011 | Hayashi | |
| 2011/0032283 | A1 * | 2/2011 | Baek | G09G 3/3413 345/690 |
| 2012/0299941 | A1 * | 11/2012 | Lee | G09G 3/3406 345/582 |
| 2012/0313985 | A1 | 12/2012 | Gotoh | |
| 2013/0026948 | A1 | 1/2013 | Kim et al. | |
| 2013/0050282 | A1 | 2/2013 | Kim et al. | |

FOREIGN PATENT DOCUMENTS

KR 1020070077721 A 7/2007

* cited by examiner

*Primary Examiner* — Seokyun Moon

(74) *Attorney, Agent, or Firm* — Cantor Colburn LLP

(57) ABSTRACT

A display device includes a display panel which displays an image corresponding to input image data and is divided into a display blocks, a light source module which includes a light source blocks respectively corresponding to the display blocks, each of the light source blocks including a first light source which emits light of a first color, and a second light source which emits light of a combination of second and third colors, a dimming controller which outputs a dimming signal, a light source module driver which drives each of the light source blocks based on the dimming signal, where the dimming controller detects block image data corresponding to each of the display blocks from the image data, calculates color data based on the block image data, and provides a first dimming signal and a second dimming signal to the light source module driver.

29 Claims, 22 Drawing Sheets

DISPLAY DEVICE

This application claims priority to Korean Patent Application No. 10-2014-0007802 filed on Jan. 22, 2014, and all the benefits accruing therefrom under 35 U.S.C. §119, the invention of which is incorporated herein by reference in its entirety.

BACKGROUND

1. Field

The invention relates to a display device.

2. Description of the Related Art

Flat panel displays ("FPDs"), such as liquid crystal displays ("LCDs") and plasma display panels ("PDPs"), are being rapidly developed to replace cathode ray tubes ("CRTs"). Of the FPDs, LCDs, unlike PDPs, cannot emit light by themselves. Thus, the LCDs use a light source. Here, the light source may be a point light source such as a light-emitting diode ("LED") or a linear light source such as an electroluminescent lamp ("EL") or a cold cathode fluorescent lamp ("CCFL"). In particular, the LED is being widely used as a light source for a backlight unit.

The interest in local dimming has significantly increased in order to improve contrast ratio and effectively reduce power consumption of products employing a backlight unit that uses an LED as a light source. That is, the entire screen area is divided into a plurality of blocks of equal sizes, and luminance dimming is performed on each of the blocks to correct the distortion of a gamma curve due to, e.g., the leakage of light of a panel. Accordingly, contrast ratio can be improved, and power consumption can be effectively reduced.

In local dimming using the above block-based luminance dimming method, the individual luminance of each block is extracted by taking the average of red, green and blue image data of the corresponding block received from an image board.

The local dimming using the block-based luminance dimming method can improve contrast ratio. However, there is still room for improvement when it comes to color display characteristics such as color reproducibility.

SUMMARY

Exemplary embodiments of the invention provide a display device which has improved color reproducibility and can be driven with effectively reduced power consumption.

However, exemplary embodiments of the invention are not restricted to the one set forth herein. The above and other exemplary embodiments of the invention will become more apparent to one of ordinary skill in the art to which the invention pertains by referencing the detailed description of the invention given below.

According to an exemplary embodiment of the invention, there is provided a display device. The display device includes a display panel which displays an image corresponding to input image data and is divided into a plurality of plurality of display blocks, a light source module which includes a plurality of light source blocks respectively corresponding to the plurality of display blocks, a dimming controller which outputs a dimming signal for adjusting a dimming duty cycle of each of the light source blocks based on the image data, a light source module driver which drives each of the light source blocks based on the dimming signal, where each of the light source blocks includes a first light source which emits light of a first color and a second light source which emits light of a combination of a second color and a third color, and the dimming controller detects block image data corresponding to each of the plurality of display blocks from the image data, calculates color data based on the block image data, and provides a first dimming signal generated for the first light source based on the color data and a second dimming signal generated for the second light source based on the color data to the light source module driver.

According to another exemplary embodiment of the invention, there is provided there is provided a display device. The display device includes a light source module which includes a plurality of light source blocks, a display panel which displays an image and is divided into a plurality of display blocks respectively corresponding to the light source blocks, a dimming controller which outputs a dimming signal for adjusting a dimming duty cycle of each of the light source blocks based on image data of the plurality of display blocks, and a light source module driver which drives each of the light source blocks based on the dimming signal, where each of the light source blocks includes a first light source which emits light of a first color, a second light source which emits light of a combination of a second color and a third color and a third light source which emits light of a fourth color, and the dimming controller detects block image data corresponding to each of the plurality of display blocks from the image data, calculates color data based on the image data of the plurality of display blocks, and provides at least one of a first dimming signal generated for the first light source based on the color data, a second dimming signal generated for the second light source based on the color data, and a third dimming signal generated for the third light source based on the color data to the light source module driver.

BRIEF DESCRIPTION OF THE DRAWINGS

The above and other exemplary embodiments and features of the invention will become more apparent by describing in detail exemplary embodiments thereof with reference to the attached drawings, in which.

DETAILED DESCRIPTION

Figure 1:
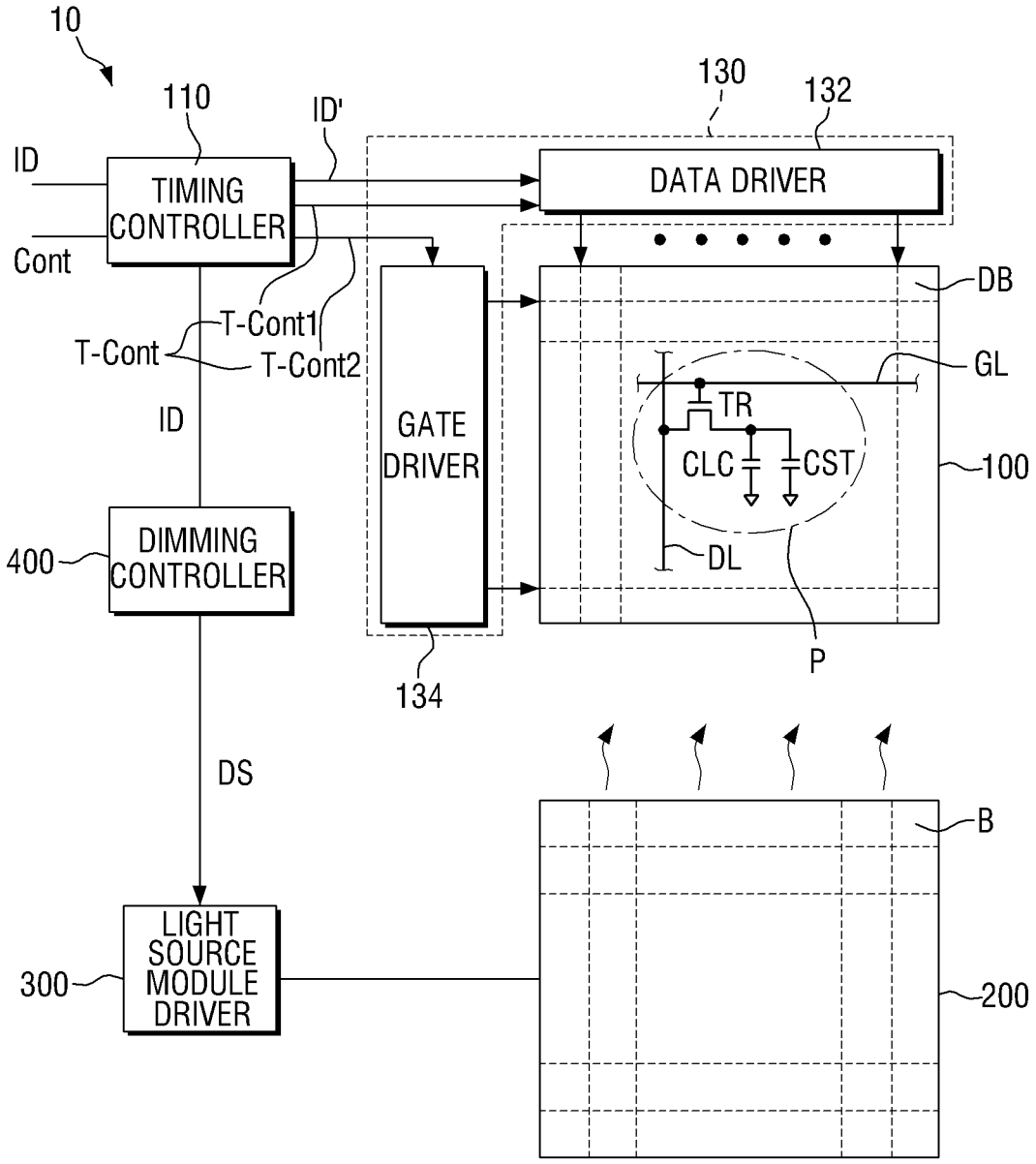
FIG. 1 is a schematic block diagram of an exemplary embodiment of a display device according to the invention.

Advantages and features of the invention and methods of accomplishing the same may be understood more readily by reference to the following detailed description of exemplary embodiments and the accompanying drawings. The invention may, however, be embodied in many different forms and should not be construed as being limited to the exemplary embodiments set forth herein. Rather, these exemplary embodiments are provided so that this invention will be thorough and complete and will fully convey the concept of the invention to those skilled in the art, and the invention will only be defined by the appended claims. Like numbers refer to like elements throughout. In the drawings, sizes and relative sizes of layers and regions may be exaggerated for clarity.

It will be understood that when an element or layer is referred to as being "on" another element or layer, it can be directly on the other element or layer or intervening elements or layers may be present.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Like reference numerals refer to like elements throughout the specification.

Embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the invention.

It will be understood that, although the terms first, second, third, etc., may be used herein to describe various elements, these elements should not be limited by these terms. These terms are only used to distinguish one element from another element. Thus, a first element discussed below could be termed a second element without departing from the teachings of the invention.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term, "about" can mean within one or more standard deviations, or within ±30%, 20%, 10%, 5% of the stated value, for example.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Hereinafter, embodiments of the invention will be described with reference to the attached drawings.

Figure 2:
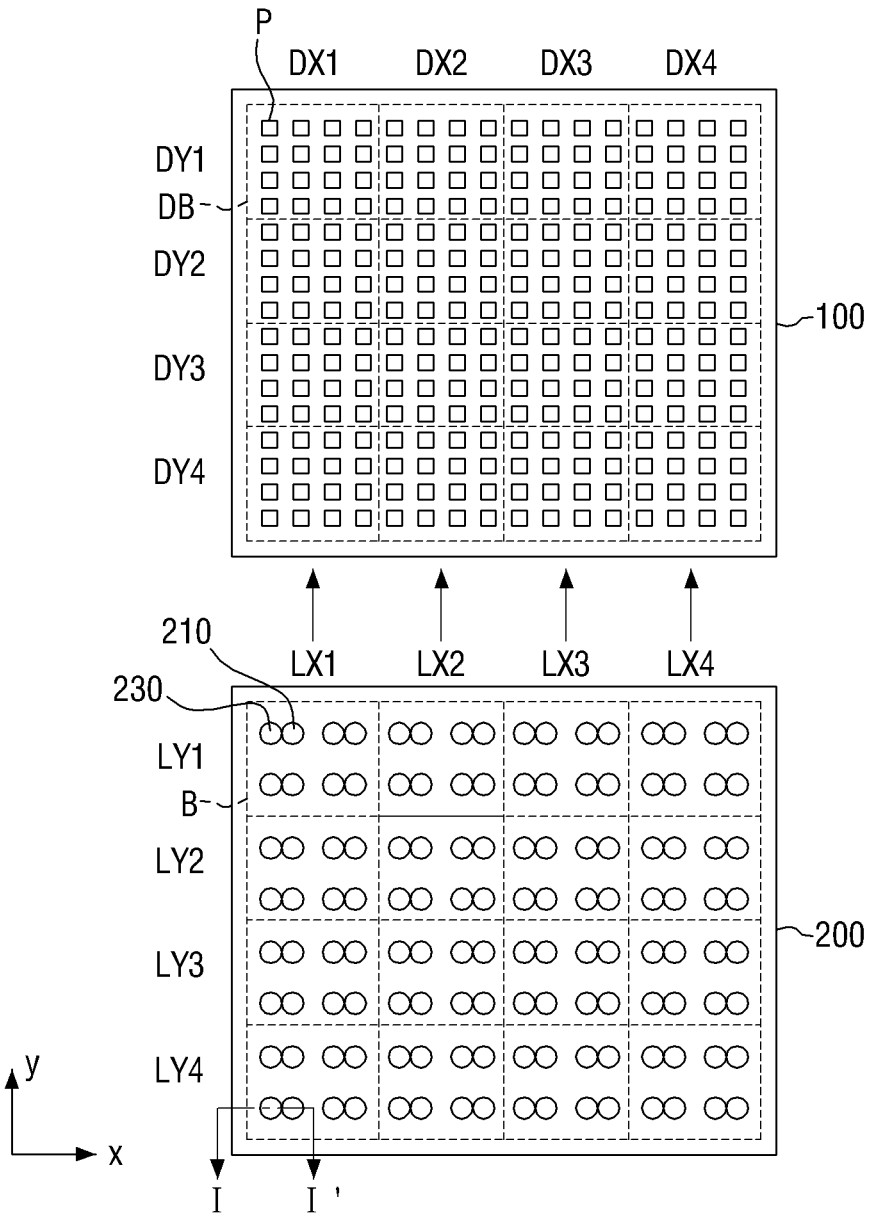
FIG. 2 is a schematic plan view of a display panel and a light source module of FIG. 1.
Figure 3:
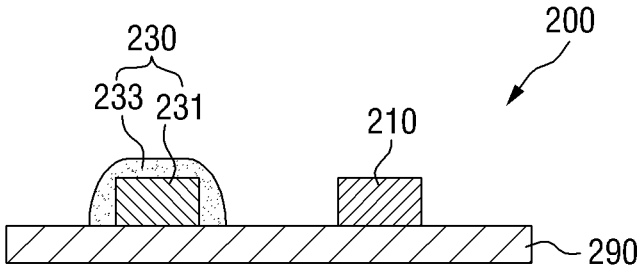
FIG. 3 is a schematic cross-sectional view of a portion of the light source module illustrated in FIG. 2.

FIG. 1 is a schematic block diagram of a display device 10 according to an exemplary embodiment of the invention. FIG. 2 is a schematic plan view of a display panel 100 and a light source module 200 of FIG. 1. FIG. 3 is a schematic cross-sectional view of a portion of the light source module 200 illustrated in FIG. 2, more specifically, a cross-sectional view of the light source module 200 taken along the line I-I' of FIG. 2.

Referring to FIG. 1, the display device 10 according to the illustrated exemplary embodiment may include the display panel 100 which displays an image, a timing controller 110, the light source module 200 which supplies light to the display panel 100, a light source module driver 300 which drives the light source module 200, and a dimming controller 400.

The display panel 100 displays an image corresponding to image data ID received from an external source. The display panel 100 may include a plurality of pixels P which display images. In an exemplary embodiment, the pixels P may be pixels of red, green and blue colors, for example. However, the invention is not limited thereto, and the pixels P may also be pixels of colors other than the red, green and blue colors. In an exemplary embodiment, the display panel 100 may also include pixels of white, emerald, and cyan colors, for example. Each of the pixels P may include a switching element TR which is connected to a gate line GL and a data line DL intersecting each other and a liquid crystal capacitor CLC and a storage capacitor CST which are connected to the switching element TR. The display panel 100 may be divided into a plurality of display blocks DB, and the number of the display blocks DB may be m×n, where m and n are natural numbers. The display blocks DB may respectively correspond to a plurality of light source blocks B of the light source module 200, which will be described later, and may receive light from the corresponding light source blocks B.

The timing controller 110 may receive a control signal Cont and the image data ID from an external device (not shown). In an exemplary embodiment, the control signal Cont may include a vertical synchronization signal, a horizontal synchronization signal, a clock signal, a data enable signal, etc. By using the control signal Cont, the timing controller 110 may generate a timing control signal T_Cont for controlling the driving timing of a panel driver 130. The timing control signal T_Cont may include a first control signal T_Cont1 for controlling the driving timing of a data driver 132 and a second control signal T_Cont2 for controlling the driving timing of a gate driver 134. The timing controller 110 may change the format of the image data ID according to interface specifications with the data driver 132 of the panel driver 130 and output the changed image data ID' to the data driver 13. In addition, the timing controller 110 may output the first control signal T_Cont1 to the data driver 132 and the second control signal T_Cont2 to the gate driver 134. In an exemplary embodiment, the first control signal T_Cont1 may include, but not limited to, an output initiation signal, a horizontal initiation signal, a clock signal, etc. In an exemplary embodiment, the second control signal T_Cont2 may include, but not limited to, a vertical initiation signal, a gate clock signal, an output enable signal, etc.

The panel driver 130 may drive the display panel 100 using the timing control signal T_Cont and the changed image data ID' received from the timing controller 110. The panel driver 130 may include the data driver 132 and the gate driver 134.

The gate driver 134 may receive a gate-on voltage and a gate-off voltage and sequentially output gate signals having the gate-on voltage in response to the second control signal T_Cont2 received from the timing controller 110. The gate signals may be sequentially transmitted to gate lines GL of the display panel 100 to sequentially scan the gate lines GL. Although not illustrated in the drawing, the display device 10 may further include a regulator which converts an input voltage into the gate-on voltage and the gate-off voltage and outputs the gate-on voltage and the gate-off voltage.

The data driver 132 may be operated by an analog driving voltage and generate a plurality of gray voltages using gamma voltages received from a gamma voltage generator (not shown). The data driver 132 may select gray voltages corresponding to the changed image data ID' from the generated gray voltages in response to the first control signal T_Cont1 received from the timing controller 110 and apply the selected gray voltages to data lines DL of the display panel 100 as data signals.

When the gate signals are sequentially transmitted to the gate lines GL, the data signals are transmitted to the data lines DL in synchronization with the gate signals. When a gate signal is transmitted to a selected gate line, a thin-film transistor ("TFT") TR connected to the selected gate line is turned on in response to the gate signal. When a data signal is transmitted to a data line connected to the turned-on TFT TR, it passes through the turned-on TFT TR to be charged in the liquid crystal capacitor CLC and the storage capacitor CST. The liquid crystal capacitor CLC adjusts light transmittance of liquid crystals according to the voltage charged therein. When the TFT TR is turned on, the storage capacitor CST accumulates a data signal. When the TFT TR is turned off, the storage capacitor CST transmits the accumulated data signal to the liquid crystal capacitor CLC, thereby keeping the liquid crystal capacitor CLC charged. In this way, the display panel 100 displays an image.

The light source module driver 300 drives a plurality of light sources included in the light source module 200. The light source module driver 300 drives the light sources of the light source module 200 based on a dimming signal DS received from the dimming controller 400.

The dimming controller 400 may generate the dimming signal DS for driving the light source module 200 based on the image data ID and provide the generated dimming signal DS to the light source module driver 300. The specific operation of the dimming controller 400 will be described later.

The light source module 200 may be disposed adjacent to the display panel 100 so as to provide light to the display panel 100. The light source module 200 may include one or more light source blocks B, and each of the light source blocks B may be dimming-driven independently. The light source blocks B may respectively correspond to the display blocks DB of the display panel 100 and provide light to the corresponding display blocks DB.

FIG. 2 is a schematic plan view of the display panel 100 and the light source module 200 of FIG. 1. FIG. 3 is a schematic cross-sectional view of a portion of the light source module 200 of FIG. 2, more specifically, a cross-sectional view of the light source module 200 taken along the line I-I' of FIG. 2.

Referring to FIGS. 1 and 2, the light source module 200 may include a plurality of light sources 210 and 230. In an exemplary embodiment, the light source module 200 may include a plurality of first light sources 210 and a plurality of second light sources 230. The first light sources 210 and the second light sources 230 may be point light sources such as a light-emitting diode ("LED") package. A first light source 210 and a second light source 230 may be disposed adjacent to each other to provide one cluster, and one or more clusters may be disposed in each of the light source blocks B. In an exemplary embodiment, the light sources 210 and 230 may be divided into sixteen light source blocks B arranged in four rows (LY1 through LY4) by four columns (LX1 through LX4). Light sources included in one light source block of the light source module 200 may be driven independently of light sources included in other light source blocks. In an exemplary embodiment, light sources included in a first light source block LY1:LX1 in a first row and a first column may be driven independently of light sources included in other light source blocks (e.g., LY2:LX2). In addition, light sources 210 and 230 included in the same light source block may be driven independently according to their colors.

The display panel 100 may include a plurality of pixels P, and the pixels P may be divided into the display blocks DB. In an exemplary embodiment, the pixels P may be divided into sixteen display blocks DY1:DX1 through DY4:DX4 arranged in four rows (DY1 through DY4) by four columns (DX1 through DX4) and corresponding to the light source blocks LY1:LX1 through LY4:LX4, respectively.

The display blocks DY1:DX1 through DY4:DX4 of the display panel 100 are virtual display regions corresponding to the light source blocks LY1:LX1 through LY4:LX4 of the light source module 200. Therefore, pixels included in different display regions may be driven independently of each other, but the invention is not limited thereto.

In FIG. 2, the light source blocks LY1:LX1 through LY4:LX4 and the display blocks DY1:DX1 through DY4:DX4 each are divided into sixteen regions. However, this is merely an exemplary embodiment used for ease of description, and the number of regions into which the blocks are divided and the arrangement of the blocks may vary according to embodiment.

Referring to FIGS. 1 through 3, the light source module 200 may include the first light sources 210 which emit light of a first color and the second light sources 230 which emit light of a combination of a second color and a third color. In an exemplary embodiment, the first through third colors may be different from each other. In an exemplary embodiment, the first color may be any one of green, blue and red, the second color may be one of green, blue and red which is different from the first color, and the third color may be one of green, blue and red which is different from the first and second colors, for example. For ease of description, the first color will hereinafter be defined as green, the second color as blue, and the third color as red, for example. However, this is merely an exemplary embodiment, and the first through third colors may vary.

In an exemplary embodiment, each of the first light sources 210 may be an LED, more specifically, a green LED which emits light of the first color (i.e., green light), for example.

In an exemplary embodiment, each of the second light sources 230 may include an LED and a phosphor, for example. More specifically, each of the second light sources 230 may include a blue LED 231 which emits light of the second color (i.e., blue light) and a red phosphor 233 which covers the blue LED 231. In an exemplary embodiment, the red phosphor 233 may include, but not limited to, at least one phosphor selected from silicate-based phosphors including a Zn2SiO4:Mn2+ phosphor, an Mg2SiO4:Mn2+ phosphor, a Ba2SiO4:Mn2+ phosphor, a Sr2SiO4:Mn2+ phosphor, a Ca 2SiO4:Mn2+ phosphor, or any combinations thereof.

The red phosphor 233 is excited by a portion of the light of the second color (i.e., blue light) emitted from the blue LED 233. As the excited red phosphor 233 becomes stable, it may emit light of the third color (i.e., red light). Therefore, each of the second light sources 230 may output the red light emitted from the red phosphor 233 and the remaining blue light which was not used to excite the red phosphor 233. That is, each of the second light sources 230 may emit magenta light which is a combination of the blue light and the red light. Here, the proportion of the red light may be controlled by the amount of the blue light.

The light source module 200 may further include a circuit board 290 on which the first light sources 210 and the second light sources 230 are mounted.

Circuit wirings for delivering driving currents to the first light sources 210 and the second light sources 230 may be disposed on the circuit board 290. In an exemplary embodiment, the circuit board 290 may include a printed circuit board ("PCB"). In an exemplary embodiment, the circuit board 290 may include, but not limited to, a metal core printed circuit board ("MCPCB") in order to improve dissipation efficiency.

The display device 10 according to the illustrated exemplary embodiment displays an image using the light source module 200 which includes only two types of light sources 210 and 230, not three types of light sources such as red, green and blue LEDs. Therefore, the structure of the display device 10 can be simplified, and the power consumption of the display device 10 can be reduced compared with when three types of LEDs are used.

Figure 4:
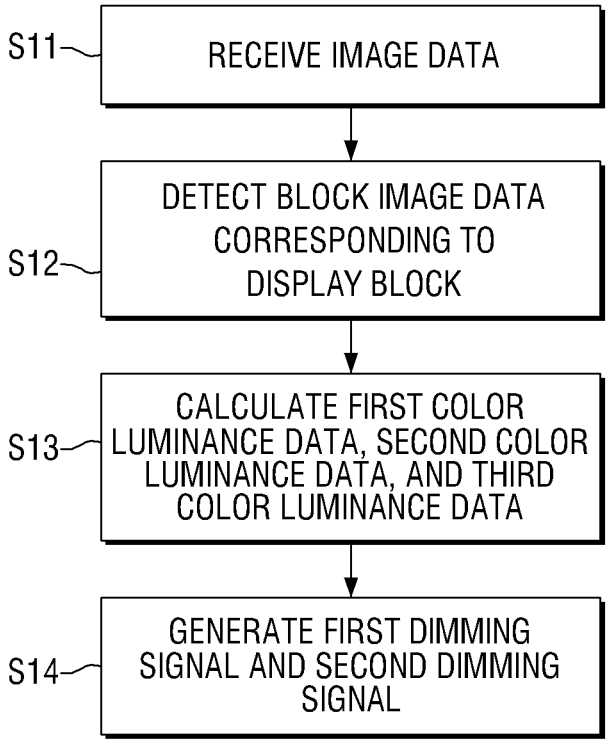
FIG. 4 is a flowchart schematically illustrating an exemplary embodiment of the operation of a dimming controller of FIG. 1 according to the invention.
Figure 5:
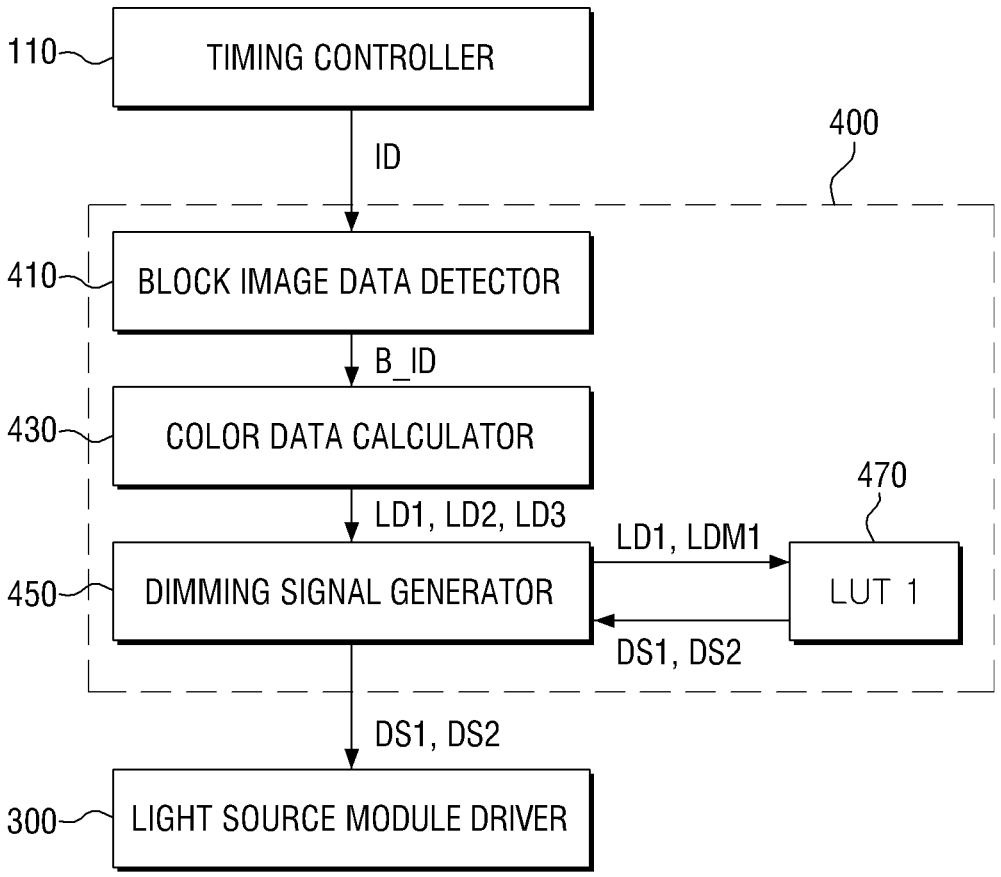
FIG. 5 is a schematic block diagram of an exemplary embodiment of the dimming controller of FIG. 1.

FIG. 4 is a flowchart schematically illustrating the operation of the dimming controller 400 of FIG. 1 according to an exemplary embodiment of the invention. FIG. 5 is a schematic block diagram of an exemplary embodiment of the dimming controller 400 of FIG. 1.

Referring to FIGS. 1 through 5, the dimming controller 400 according to the illustrated exemplary embodiment may receive image data (operation S11), detect block image data corresponding to each display block from the received image data (operation S12), calculate first color luminance data, second color luminance data and third color luminance data based on the detected block image data (operation S13), and generate a first dimming signal using the first color luminance data and a second dimming signal based on the second color luminance data and the third color luminance data (operation S14).

The dimming controller 400 performing the above operations may include a block image data detector 410, a color data calculator 430 and a dimming signal generator 450 and may further include a first lookup table ("LUT") 470.

The receiving of the image data (operation S11) and the detecting of the block image data corresponding to each display block from the received image data (operation S12) may be performed by the block image data detector 410. More specifically, when the block image data detector 410 of the dimming controller 400 receives image data ID from the timing controller 110, it may divide the screen of the display panel 100 into a plurality of display blocks DB based on the received image data ID and detect block image data B_ID corresponding to each of the display blocks DB.

The calculating of the first color luminance data, the second color luminance data and the third color luminance data based on the detected block image data (operation S13) may be performed by the color data calculator 430. More specifically, the color data calculator 430 calculates luminance data of each color by using the block image data B_ID detected by the block image data detector 410. The luminance data of each color may be first color luminance data LD1, second color luminance data LD2, and third color luminance data LD3. In an exemplary embodiment, the first color, the second color, and the third color may be, but are not limited to, red, blue, and green, respectively. That is, in an exemplary embodiment, the first color luminance data LD1, the second color luminance data LD2, and the third color luminance data LD3 may be red luminance data LD1, blue luminance data LD2, and green luminance data LD3, respectively, for example.

In an exemplary embodiment, each luminance data LD1, LD2 or LD3 may be average luminance data of a display block DB for each color. However, the invention is not limited thereto, and each luminance data LD1, LD2 or LD3 may be any one of corrected data determined for each color by calculating at least one of a variance, a standard deviation, a skewness, a kurtosis, a central moment, and an image moment using maximum luminance data of a display block DB for each color, minimum luminance data of the display block DB for each color, median luminance data of the display block DB for each color, mode luminance data of the display block DB for each color, and average luminance data of the display block DB for each color, for example.

The generating of the first dimming signal using the first color luminance data and the second dimming signal based on the second color luminance data and the third color luminance data (operation S14) may be performed by the dimming signal generator 450. The dimming signal generator 450 may generate a first dimming signal DS1 and a second dimming signal DS2 which determine a dimming duty cycle of each of the first light sources 210 and a dimming duty cycle of each of the second light sources 230 in the light source module 200 and provide the first dimming signal DS1 and the second dimming signal DS2 to the light source module driver 300. More specifically, the dimming signal generator 450 generates the first dimming signal DS1 for the first light sources 210 which emit light of the first color (e.g., green light) based on the first color luminance data LD1 received from the color data calculator 430. At the same or different time, the dimming signal generator 450 generates the second dimming signal DS2 for the second light sources 230 which emit a combination (e.g., magenta light) of light of the second color (e.g., blue light) and light of the third color (e.g., red light) based on the second color luminance data LD2 and the third color luminance data LD3 received from the color data calculator 430. The first dimming signal DS1 and the second dimming signal DS2 may be provided to the light source module driver 300, and the light source module driver 300 may drive the first and second light sources 210 and 230 of the light source module 200 based on the first dimming signal DS1 and the second dimming signal DS2.

In an exemplary embodiment, the dimming signal generator 450 may generate the first dimming signal DS1 and the second dimming signal DS2 using the first LUT 470 which stores a dimming duty cycle corresponding to a luminance level of each color. That is, the dimming signal generator 450 may extract a dimming duty cycle corresponding to the first color luminance data LD1 from the first LUT 470 and generate the first dimming signal DS1 based on the extracted dimming duty cycle. In addition, the dimming signal generator 450 may generate mixed color luminance data LDM1 based on the second color luminance data LD2 and the third color luminance data LD3, extract a dimming duty cycle corresponding to the mixed color luminance data LDM1 from the first LUT 470, and generate the second dimming signal DS2 based on the extracted dimming duty cycle. Here, the mixed color luminance data LDM1 may be, but is not limited to, the sum of the second color luminance data LD2 and the third color luminance data LD3.

Figure 6:
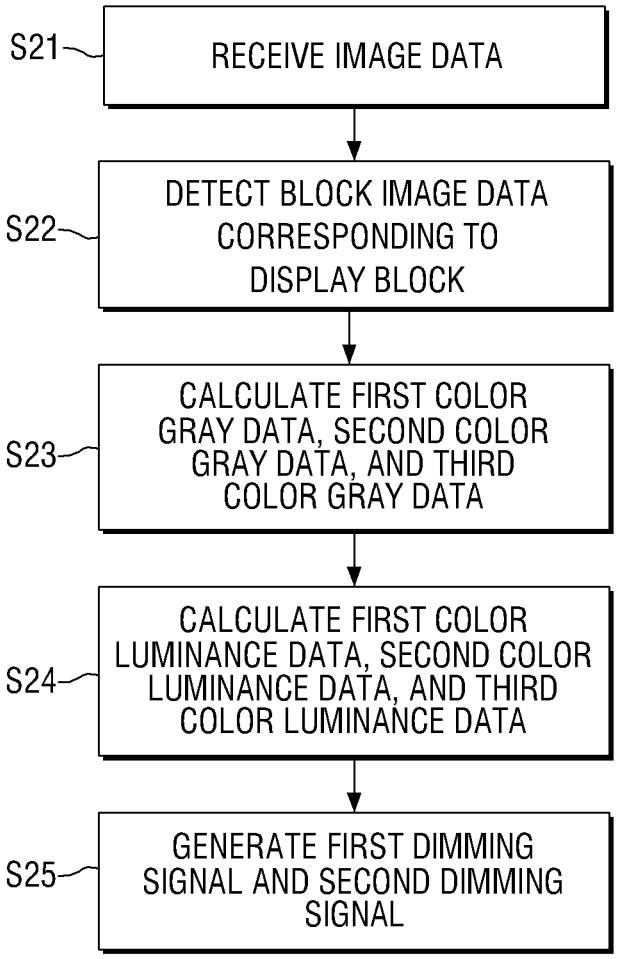
FIG. 6 is a flowchart schematically illustrating another exemplary embodiment of the operation of the dimming controller of FIG. 1 according to the invention.
Figure 7:
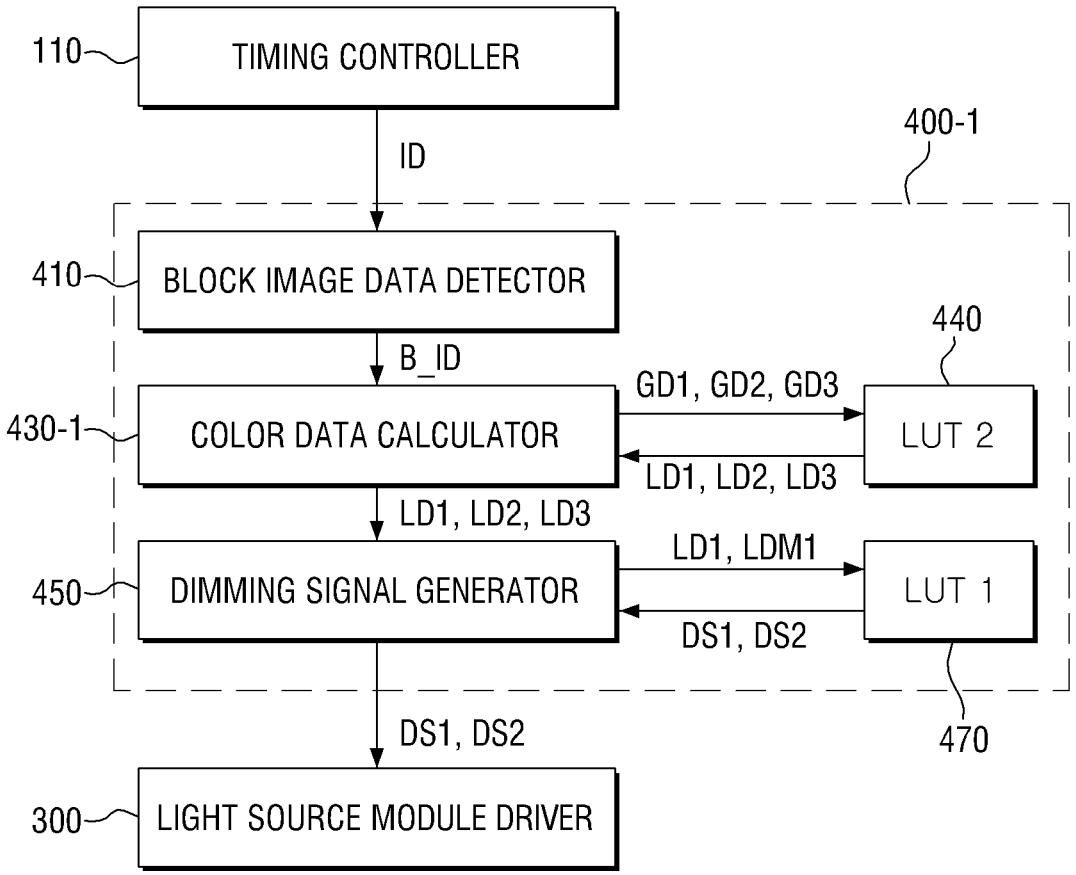
FIG. 7 is a schematic block diagram of another embodiment of the dimming controller of FIG. 1.

FIG. 6 is a flowchart schematically illustrating the operation of the dimming controller 400 of FIG. 1 according to another embodiment of the invention. FIG. 7 is a schematic block diagram of another embodiment of the dimming controller 400 of FIG. 1.

Referring to FIGS. 1 through 3, 6 and 7, a dimming controller 400-1 according to the illustrated exemplary embodiment may receive image data (operation S21), detect block image data corresponding to each display block from the received image data (operation S22), calculate first color gray data, second color gray data, and third color gray data based on the detected block image data (operation S23), calculate first color luminance data, second color luminance data, and third color luminance data based on the first color gray data, the second color gray data, and the third color gray data (operation S24), and generate a first dimming signal using the first color luminance data and a second dimming signal based on the second color luminance data and the third color luminance data (operation S25).

The dimming controller 400-1 performing the above operations may include a block image data detector 410, a color data calculator 430-1 and a dimming signal generator 450 and may further include a first LUT 470 and a second LUT 440. That is, the dimming controller 400-1 according to the illustrated exemplary embodiment is different from the dimming controller 400 described above with reference to FIGS. 4 and 5 in that it further includes the second LUT 440 and that the color data calculator 430-1 operates differently from the color data calculator 430 of the dimming controller 400. Other elements and operations are the same as those described above with reference to FIGS. 4 and 5, and thus a redundant description thereof will be given briefly or omitted for the sake of simplicity.

The receiving of the image data (operation S21) and the detecting of the block image data corresponding to each display block from the received image data (operation S22) may be performed by the block image data detector 410. More specifically, when the block image data detector 410 of the dimming controller 400-1 receives image data ID from the timing controller 110, it may divide the screen of the display panel 100 into a plurality of display blocks DB based on the received image data ID and detect block image data B_ID corresponding to each of the display blocks DB.

The calculating of the first color gray data, the second color gray data and the third color gray data based on the detected block image data (operation S23) and the calculating of the first color luminance data, the second color luminance data and the third color luminance data based on the first color gray data, the second color gray data and the third color gray data (operation S24) may be performed by the color data calculator 430-1. More specifically, the color data calculator 430-1 calculates gray data of each color by using the block image data B_ID detected by the block image data detector 410. The gray data of each color may be first color gray data GD1, second color gray data GD2, and third color gray data GD3. In an exemplary embodiment, the first color, the second color, and the third color may be, but are not limited to, red, blue, and green, respectively, for example. That is, in an exemplary embodiment, the first color gray data GD1, the second color gray data GD2, and the third color gray data GD3 may be red gray data GD1, blue gray data GD2, and green gray data GD3, respectively, for example. In an exemplary embodiment, each of the first color gray data GD1, the second color gray data GD2, and the third color gray data GD3 may be data having any one of 0 to 255 values, but the invention is not limited thereto.

In an exemplary embodiment, each gray data GD1, GD2 or GD3 may be average gray data of a display block DB for each color. However, the invention is not limited thereto, and each gray data GD1, GD2 or GD3 may be any one of corrected gray data determined for each color by calculating at least one of a variance, a standard deviation, a skewness, a kurtosis, a central moment, and an image moment using maximum gray data of a display block DB for each color, minimum gray data of the display block DB for each color, median gray data of the display block DB for each color, mode gray data of the display block DB for each color, and average gray data of the display block DB for each color, for example.

The color data calculator 430-1 may calculate first color luminance data LD1, second color luminance data LD2, and third color luminance data LD3 based on the first color gray data GD1, the second color gray data GD2, and the third color gray data GD3.

In an exemplary embodiment, the color data calculator 430-1 may calculate the first color luminance data LD1, the second color luminance data LD2, and the third color luminance data LD3 using the second LUT 440 which stores a luminance level corresponding to a gray level of each color. That is, the color data calculator 430-1 may extract the first color luminance data LD1 corresponding to the first color gray data GD1 from the second LUT 440. Likewise, the color data calculator 430-1 may extract the second color luminance data LD2 and the third color luminance data LD3 corresponding respectively to the second color gray data GD2 and the third color gray data GD3 from the second LUT 440.

The generating of the first dimming signal using the first color luminance data and the second dimming signal based on the second color luminance data and the third color luminance data (operation S25) may be performed by the dimming signal generator 450. The dimming signal generator 450 may generate a first dimming signal DS1 and a second dimming signal DS2 which determine a dimming duty cycle of each of the first light sources 210 and a dimming duty cycle of each of the second light sources 230 in the light source module 200 and provide the first dimming signal DS1 and the second dimming signal DS2 to the light source module driver 300. Other operations of the dimming signal generator 450 is the same as that of the dimming signal generator 450 described above with reference to FIGS. 4 and 5, and thus a description thereof will be omitted.

Figure 8:
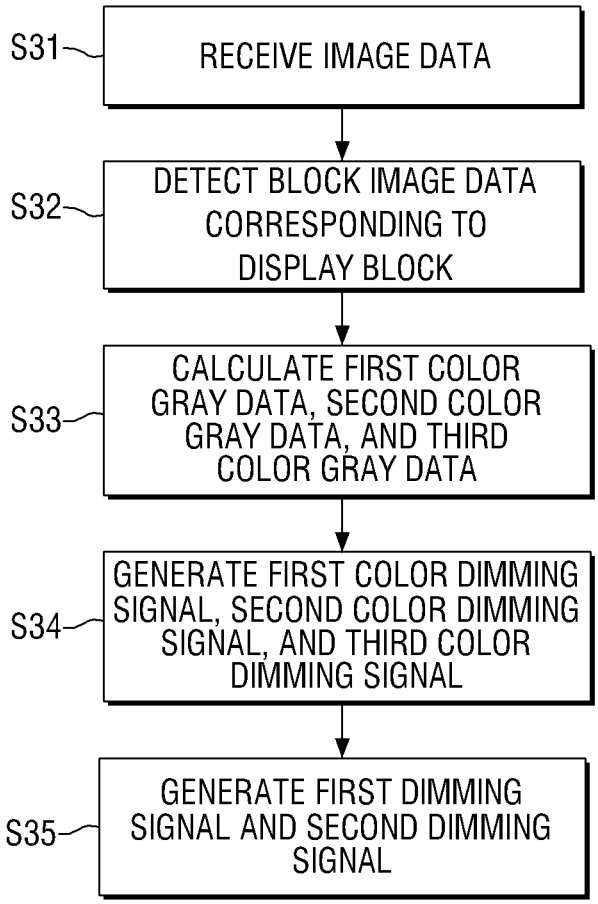
FIG. 8 is a flowchart schematically illustrating another embodiment of the operation of the dimming controller of FIG. 1 according to the invention.
Figure 9:
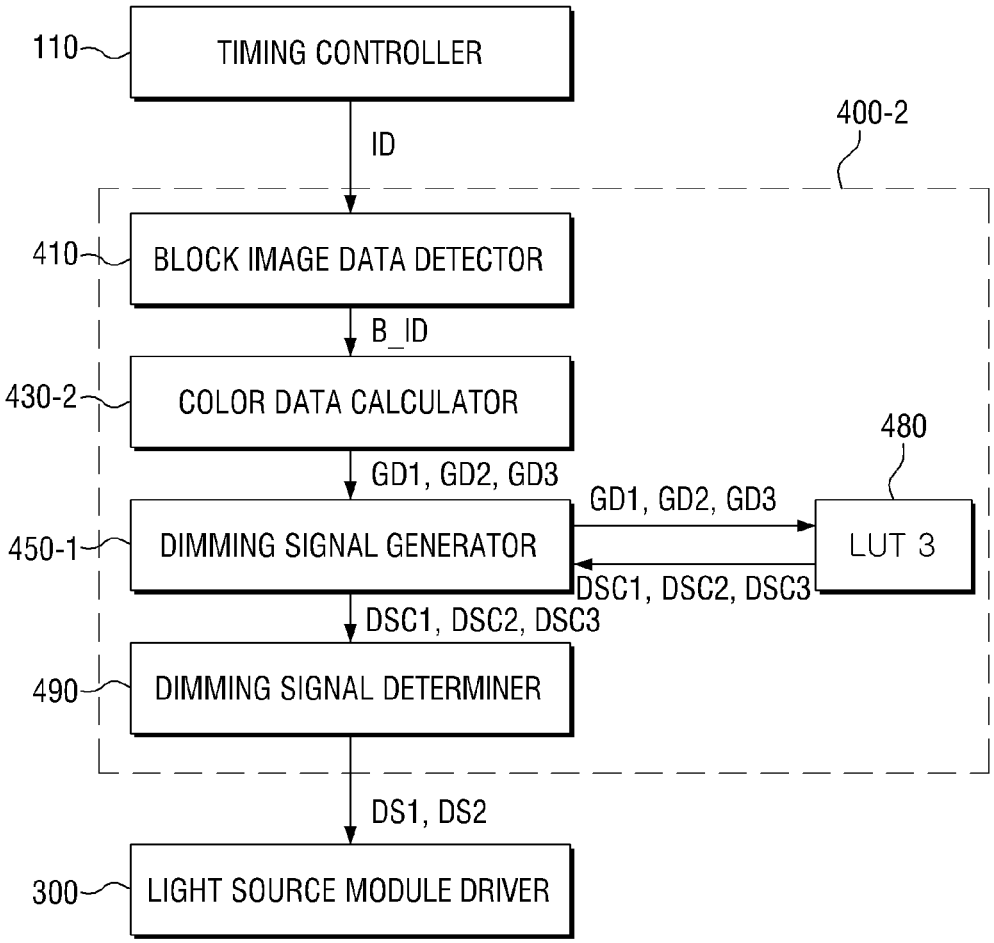
FIG. 9 is a schematic block diagram of another embodiment of the dimming controller of FIG. 1.

FIG. 8 is a flowchart schematically illustrating the operation of the dimming controller 400 of FIG. 1 according to another embodiment of the invention. FIG. 9 is a schematic block diagram of another embodiment of the dimming controller 400 of FIG. 1.

Referring to FIGS. 1 through 3, 8 and 9, a dimming controller 400-2 according to the illustrated exemplary embodiment may receive image data (operation S31), detect block image data corresponding to each display block from the received image data (operation S32), calculate first color gray data, second color gray data, and third color gray data based on the detected block image data (operation S33), generate a first color dimming signal, a second color dimming signal, and a third color dimming signal using the first color gray data, the second color gray data, and the third color gray data (operation S34), and determine a first dimming signal and a second dimming signal based on the first color dimming signal, the second color dimming signal, and the third color dimming signal (operation S35).

The dimming controller 400-2 performing the above operations may include a block image data detector 410, a color data calculator 430-2, a dimming signal generator 450-1 and a dimming signal determiner 490 and may further include a third LUT 480. That is, the dimming controller 400-2 according to the illustrated exemplary embodiment is different from the dimming controller 400 described above with reference to FIGS. 4 and 5 in that it includes the third LUT 480 and further includes the dimming signal determiner 490 and that the color data calculator 430-2 and the dimming signal generator 450-1 operate differently from the color data calculator 430 and the dimming signal generator 450 of the dimming controller 400. Other elements and operations are the same as those described above with reference to FIGS. 4 and 5, and thus a redundant description thereof will be given briefly or omitted for the sake of simplicity.

The receiving of the image data (operation S31) and the detecting of the block image data corresponding to each display block from the received image data (operation S32) may be performed by the block image data detector 410.

The calculating of the first color gray data, the second color gray data and the third color gray data based on the detected block image data (operation S33) may be performed by the color data calculator 430-2. More specifically, the color data calculator 430-2 calculates gray data of each color by using block image data B_ID detected by the block image data detector 410. The gray data of each color may be first color gray data GD1, second color gray data GD2, and third color gray data GD3. In an exemplary embodiment, the first color, the second color, and the third color may be, but are not limited to, red, blue, and green, respectively. That is, in an exemplary embodiment, the first color gray data GD1, the second color gray data GD2, and the third color gray data GD3 may be red gray data GD1, blue gray data GD2, and green gray data GD3, respectively, for example. In an exemplary embodiment, each of the first color gray data GD1, the second color gray data GD2, and the third color gray data GD3 may be data having any one of 0 to 255 values, but the invention is not limited thereto. In addition, in an exemplary embodiment, each gray data GD1, GD2 or GD3 may be, but is not limited to, average gray data of a display block DB for each color.

The generating of the first color dimming signal, the second color dimming signal, and the third color dimming signal using the first color gray data, the second color gray data, and the third color gray data (operation S34) may be performed by the dimming signal generator 450-1. The dimming signal generator 450-1 may generate a first color dimming signal DSC1, a second color dimming signal DSC2, and a third color dimming signal DSC3 for the first color gray data GD1, the second color gray data GD2, and the third color gray data GD3, respectively. Assuming that the light source module 200 includes light sources of the first color, light sources of the second color, and light sources of the third color, the first color dimming signal DSC1, the second color dimming signal DSC2, and the third color dimming signal DSC3 are signals respectively indicating dimming duty cycles of the virtual light sources of the first through third colors.

In an exemplary embodiment, the dimming signal generator 450-1 may generate the first color dimming signal DSC1, the second color dimming signal DSC2, and the third color dimming signal DSC3 using the third LUT 480 which stores a dimming duty cycle corresponding to a gray level of each color. That is, the dimming signal generator 450-1 may extract a dimming duty cycle corresponding to each of the first color gray data GD1, the second color gray data GD2, and the third color gray data GD3 and generate the first color dimming signal DSC1, the second color dimming signal DSC2, and the third color dimming signal DSC3 based on the extracted dimming duty cycle.

The determining of the first dimming signal and the second dimming signal based on the first color dimming signal, the second color dimming signal, and the third color dimming signal (operation S35) may be performed by the dimming signal determiner 490.

The dimming signal determiner 490 determines a first dimming signal DS1 and a second dimming signal DS2 which determine a dimming duty cycle of each of the first light sources 210 and a dimming duty cycle of each of the second light sources 230 in the light source module 200 and provide the first dimming signal DS1 and the second dimming signal DS2 to the light source module driver 300. The dimming signal determiner 490 may determine the first color dimming signal DSC1 to be the first dimming signal DS1. In addition, the dimming signal determiner 490 may determine the second dimming signal DS2 based on the second color dimming signal DSC2 and the third color dimming signal DSC3. In an exemplary embodiment, the dimming signal determiner 490 may determine a signal having a greater gray value among the second color dimming signal DSC2 and the third color dimming signal DSC3 to be the second dimming signal DS2. In alternative exemplary embodiment, the dimming signal determiner 490 may determine a signal having a smaller gray value among the second color dimming signal DSC2 and the third color dimming signal DSC3 to be the second dimming signal DS2. In an alternative exemplary embodiment, the dimming signal determiner 490 may determine an average value of the second color dimming signal DSC2 and the third color dimming signal DSC3 to be the second dimming signal DS2. In an alternative exemplary embodiment, the dimming signal determiner 490 may assign a specific weight to each of the second color dimming signal DSC2 and the third color dimming signal DSC3 and determine an average value of the weighted second color dimming signal DSC2 and the weighted third color dimming signal DSC3 to be the second dimming signal DS2.

Figure 10:
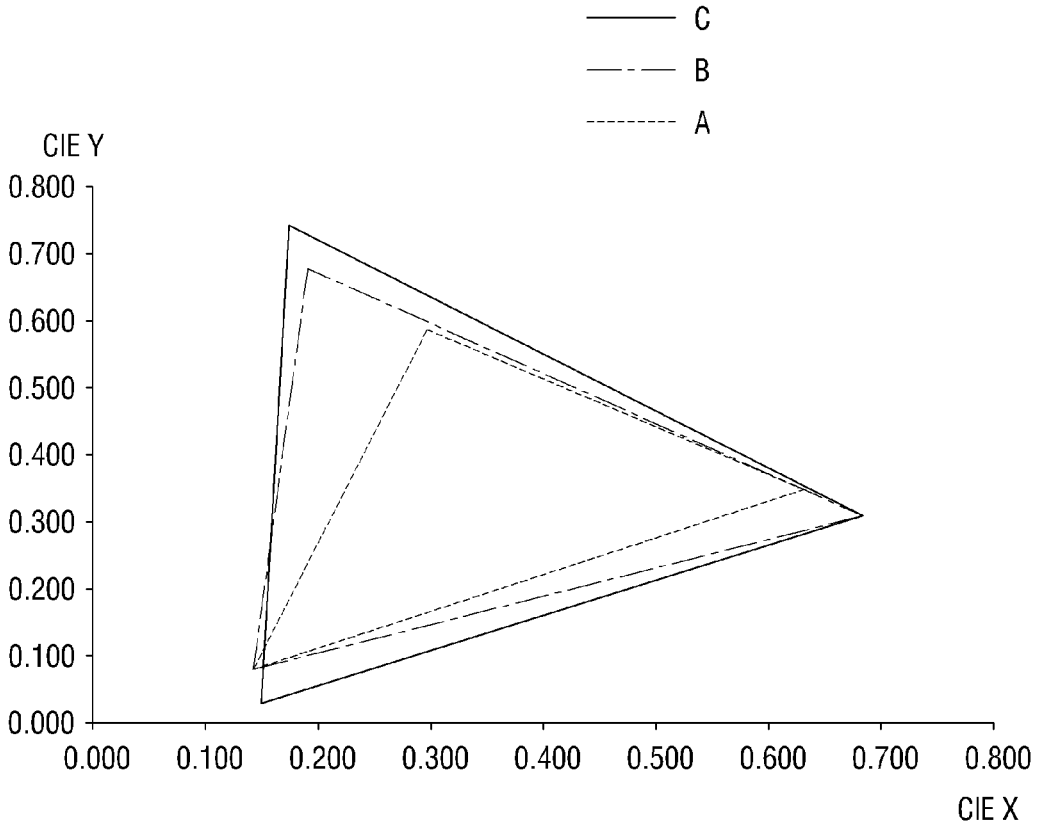
FIG. 10 illustrates an exemplary embodiment of color coordinates representing the color reproducibility of an image realized on a display device according to the invention.

FIG. 10 illustrates CIE color coordinates representing the color reproducibility of an image realized on a display device according to an exemplary embodiment of the invention. More specifically, 'A' represents color coordinates of an image realized on a display device (hereinafter, referred to as 'display device A') which includes red, green and blue LEDs, 'B' represents color coordinates of an image realized on a display device (hereinafter, referred to as 'display device B') which includes first light sources, each having a green LED, and second light sources, each having a blue LED and a red phosphor, and does not perform dimming driving, and 'C' represents color coordinates of an image realized on a display device according to an exemplary embodiment of the invention which includes first light sources, each having a green LED, and second light sources, each having a blue LED and a red phosphor, and performs dimming driving.

Referring to FIG. 10, display devices that display images express all colors by additively mixing red, green and blue colors. A region of colors expressed by the additive mixing of the above three colors is referred to as a color space, and a two-dimensional representation of the color space is referred to as color coordinates. As a display device has a wider color space, its color reproducibility is defined as more superior. It can be understood from FIG. 10 that the area of a triangle A of display device A is smaller than the area of a triangle B of display device B and that the area of a triangle C of the display device according to an exemplary embodiment of the invention is greater than those of the triangles A and B. Thus, the display device of the invention has far more superior color reproducibility.

That is, according to the current embodiment, of a plurality of light sources, light sources not necessary for realizing an image are turned off, or the amount of current supplied to these light sources is reduced. Therefore, the power consumption of a display device can be reduced. In addition, since the number of components included in each light source can be reduced, the volume and weight of the display device can be reduced. Furthermore, a display device having improved color reproducibility can be provided.

Figure 11:
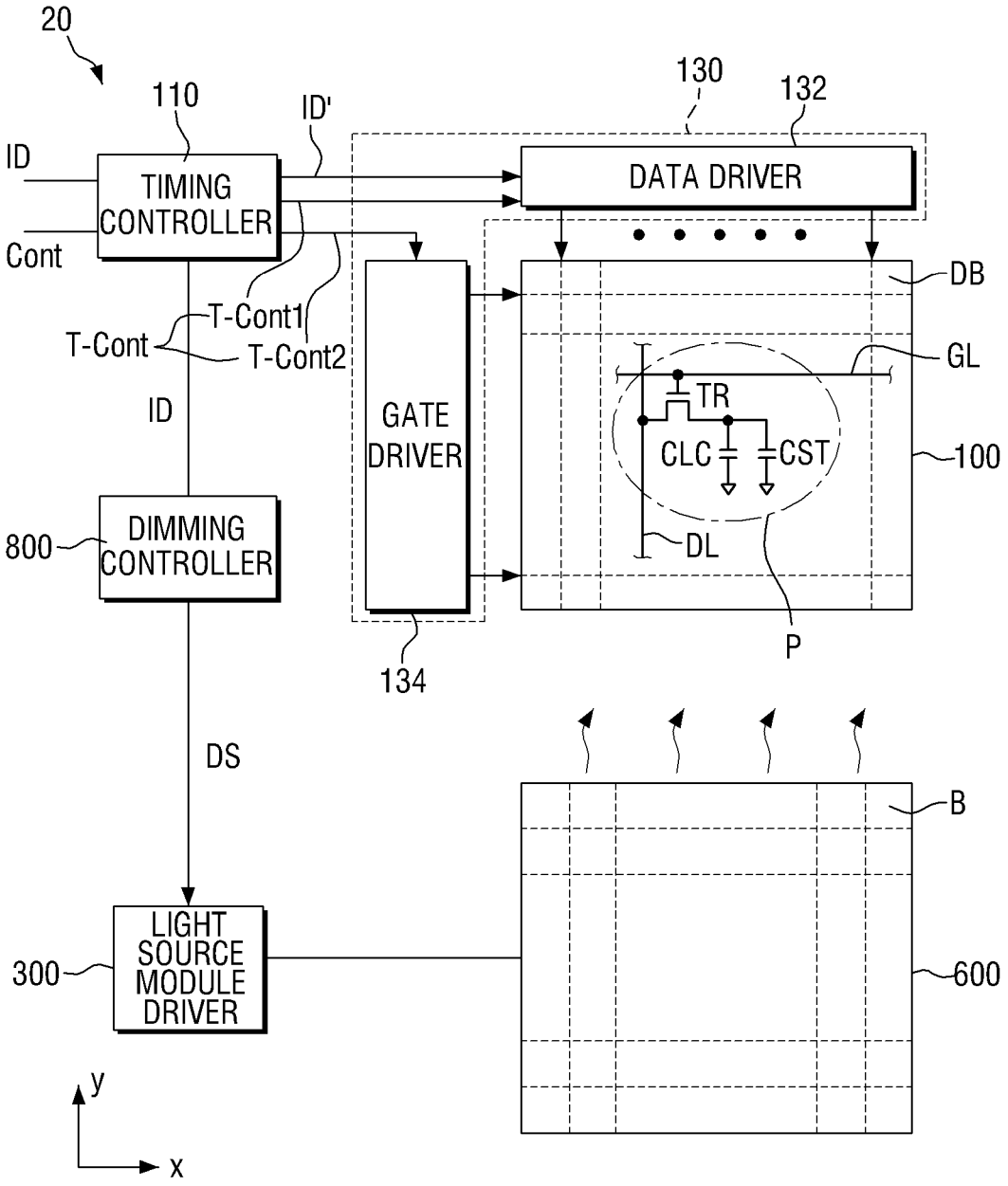
FIG. 11 is a schematic block diagram of another exemplary embodiment of a display device according to the invention.
Figure 12:
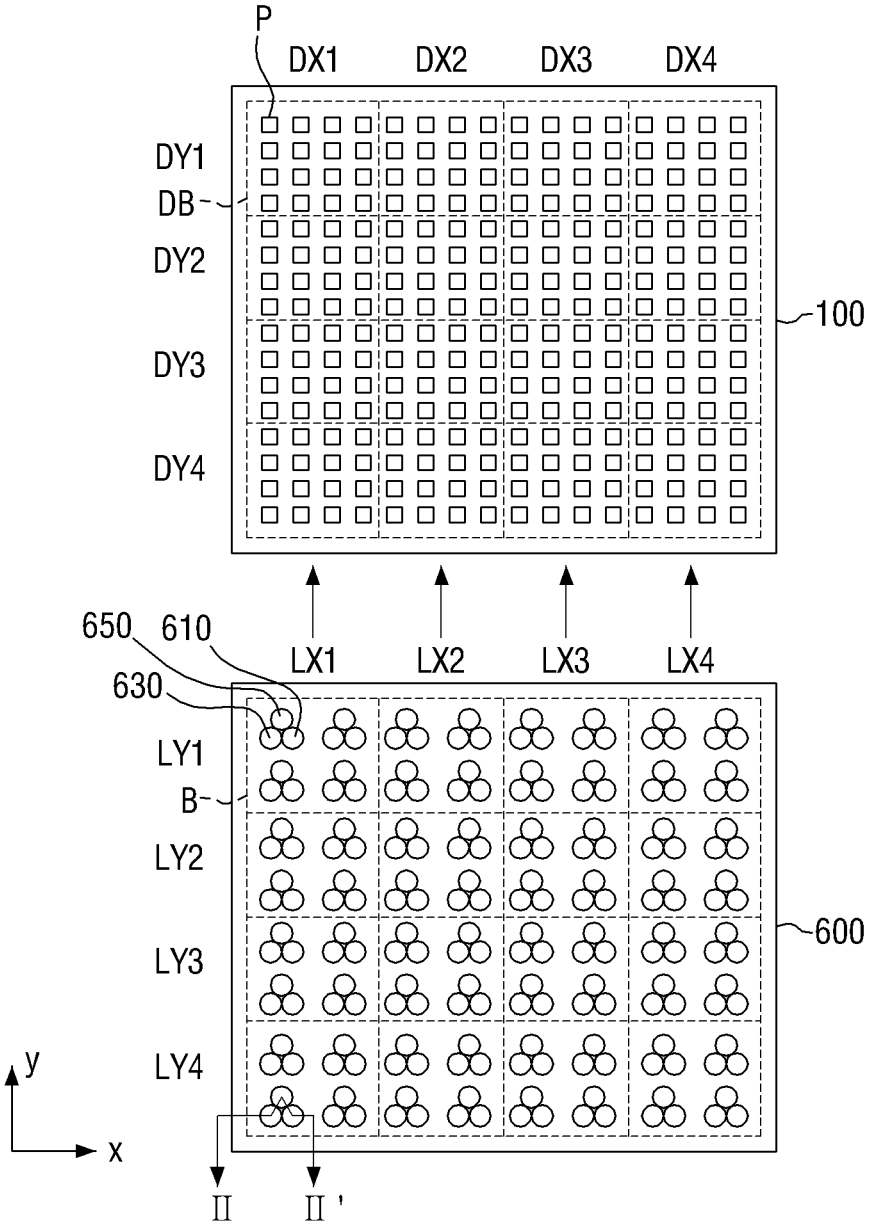
FIG. 12 is a schematic plan view of a display panel and a light source module of FIG. 11.
Figure 13:
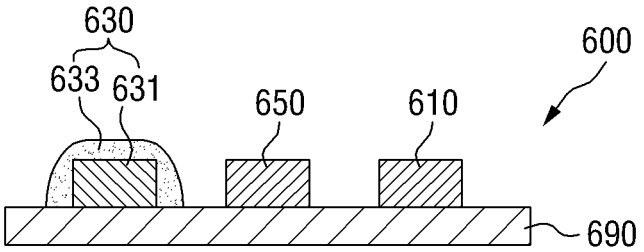
FIG. 13 is a schematic cross-sectional view of a portion of the light source module illustrated in FIG. 12.
Figure 14:
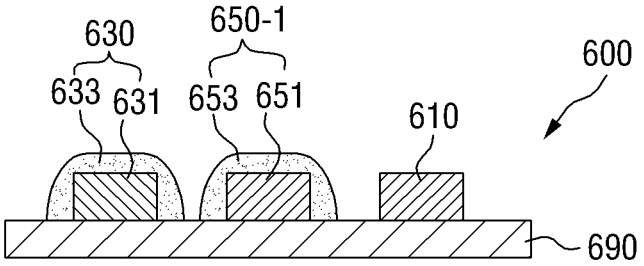
FIG. 14 is a schematic cross-sectional view of a modified embodiment of the light source module illustrated in FIG. 13.

FIG. 11 is a schematic block diagram of a display device 20 according to another embodiment of the invention. FIG. 12 is a schematic plan view of a display panel 100 and a light source module 600 of FIG. 11. FIG. 13 is a schematic cross-sectional view of a portion of the light source module 600 illustrated in FIG. 12, more specifically, a cross-sectional view of the light source module 600 taken along the line II-IF of FIG. 12. FIG. 14 is a schematic cross-sectional view of a modified embodiment of the light source module 600 illustrated in FIG. 13.

The display device 20 according to the illustrated exemplary embodiment includes a dimming controller 800 and the light source module 600 different from those of the display device 10 illustrated in FIGS. 1 through 3. Other elements are the same as those of the display device 10 illustrated in FIGS. 1 through 3, and thus a redundant description thereof will be given briefly or omitted for the sake of simplicity.

Referring to FIG. 11, the display device 20 according to the illustrated exemplary embodiment may include the display panel 100 which displays an image, a timing controller 110, the light source module 600 which supplies light to the display panel 100, a light source module driver 300 which drives the light source module 600, and the dimming controller 800.

The display panel 100 displays an image corresponding to image data ID received from an external source. The display panel 100 may include a plurality of pixels P which display images. In addition, the display panel 100 may be divided into a plurality of display blocks DB, and the number of the display blocks DB may be m×n, where m and n are natural numbers. The display blocks DB may respectively correspond to a plurality of light source blocks B of the light source module 600, which will be described later, and may receive light from the corresponding light source blocks B.

The timing controller 110 may receive a control signal Cont and the image data ID from an external device (not shown) and generate a timing control signal T_Cont for controlling the driving timing of a panel driver 130. The timing control signal T_Cont may include a first control signal T_Cont1 for controlling the driving timing of a data driver 132 and a second control signal T_Cont2 for controlling the driving timing of a gate driver 134.

The panel driver 130 may drive the display panel 100 using the timing control signal T_Cont and the changed image data ID' received from the timing controller 110. The panel driver 130 may include the data driver 132 and the gate driver 134.

The light source module driver 300 drives a plurality of light sources included in the light source module 600. The light source module driver 300 drives the light sources of the light source module 600 based on a dimming signal DS received from the dimming controller 800.

The dimming controller 800 may generate the dimming signal DS for driving the light source module 600 based on the image data ID and provide the generated dimming signal DS to the light source module driver 300. The specific operation of the dimming controller 800 will be described later.

The light source module 600 may be disposed adjacent to the display panel 100 so as to provide light to the display panel 100. The light source module 600 may include one or more light source blocks B, and each of the light source blocks B may be dimming-driven independently. The light source blocks B may respectively correspond to the display blocks DB of the display panel 100 and provide light to the corresponding display blocks DB.

FIG. 12 is a schematic plan view of the display panel 100 and the light source module 600 of FIG. 11. FIG. 13 is a schematic cross-sectional view of a portion of the light source module 600 of FIG. 12, more specifically, a cross-sectional view of the light source module 600 taken along the line II-II' of FIG. 12. FIG. 14 is a schematic cross-sectional view of a modified embodiment of the light source module 600 illustrated in FIG. 13.

Referring to FIGS. 11 and 12, the light source module 600 may include a plurality of light sources 610, 630 and 650. In an exemplary embodiment, the light source module 600 may include a plurality of first light sources 610, a plurality of second light sources 630, and a plurality of third light sources 650. In an exemplary embodiment, the first light sources 610, the second light sources 630, and the third light sources 650 may be point light sources such as an LED package. A first light source 610, a second light source 630, and a third light source 650 may be disposed adjacent to each other to provide one cluster, and one or more clusters may be disposed in each of the light source blocks B. In an exemplary embodiment, the light sources 610, 630 and 650 may be divided into 16 light source blocks B arranged in 4 rows (LY1 through LY4)×4 columns (LX1 through LX4). Light sources included in one light source block of the light source module 600 may be driven independently of light sources included in other light source blocks. In an exemplary embodiment, light sources included in a first light source block LY1:LX1 in a first row and a first column may be driven independently of light sources included in other light source blocks (e.g., LY2:LX2). In addition, light sources 610, 630 and 650 included in the same light source block may be driven independently according to their colors.

The display panel 100 may include a plurality of pixels P, and the pixels P may be divided into the display blocks DB. In an exemplary embodiment, the pixels P may be divided into sixteen display blocks DY1:DX1 through DY4:DX4 arranged in four rows (DY1 through DY4) by four columns (DX1 through DX4) and corresponding to the light source blocks LY1:LX1 through LY4:LX4, respectively.

Other features of the display panel 100 are the same as those of the display panel 100 described above with reference to FIG. 2, and thus a description thereof will be omitted.

Referring to FIGS. 11 through 14, the light source module 600 may include the first light sources 610 which emit light of a first color, the second light sources 630 which emit light of a combination of a second color and a third color, and the third light sources 650 which emit light of a fourth color, as illustrated in FIGS. 11 through 13. The first through fourth colors may be different from each other. In an exemplary embodiment, the first color may be any one of green, blue and red, the second color may be one of green, blue and red which is different from the first color, the third color may be one of green, blue and red which is different from the first and second colors, and the fourth color may be a combination of the first color and the second color. For ease of description, the first color will hereinafter be defined as green, the second color as blue, the third color as red, and the fourth color as cyan, for example. However, this is merely an exemplary embodiment, and the first through fourth colors can vary.

Each of the first light sources 610 may include an LED, more specifically, a green LED which emits light of the first color (i.e., green light).

Each of the second light sources 630 may include an LED and a phosphor. More specifically, each of the second light sources 630 may include a blue LED 631 which emits light of the second color (i.e., blue light) and a red phosphor 633 which covers the blue LED 631. In an exemplary embodiment, each of the second light sources 630 may emit magenta light which is a combination of blue light and red light, for example. Here, the proportion of the red light may be controlled by the amount of the blue light.

Each of the third light sources 650 may include an LED, more specifically, a cyan LED which emits light of the fourth color (i.e., cyan light), for example.

In an alternative exemplary embodiment, referring to FIG. 14, each of third light sources 650-1 may include an LED and a phosphor, more specifically, a cyan LED 651 which emits light of the fourth color (i.e., cyan light) and a phosphor 653 of a fifth color which covers the cyan LED 651. In an exemplary embodiment, the fifth color may be a complementary color to the fourth color. In an exemplary embodiment, when the fourth color is cyan, the fifth color may be red. That is, the phosphor 653 of the fifth color may be red phosphor, for example. Since the red phosphor has been described above in detail with reference to FIG. 2, a description thereof will be omitted.

The light source module 600 may further include a circuit board 690 on which the first light sources 610, the second light sources 630, and the third light sources 650 or third light sources 650-1 are mounted.

Circuit wirings for delivering driving currents to the first light sources 610, the second light sources 630 and the third light sources 650 or third light sources 650-1 may be disposed on the circuit board 690. In an exemplary embodiment, the circuit board 690 may include a PCB, for example. In an exemplary embodiment, the circuit board 690 may include, but not limited to, an MCPCB in order to improve dissipation efficiency.

Figure 15:
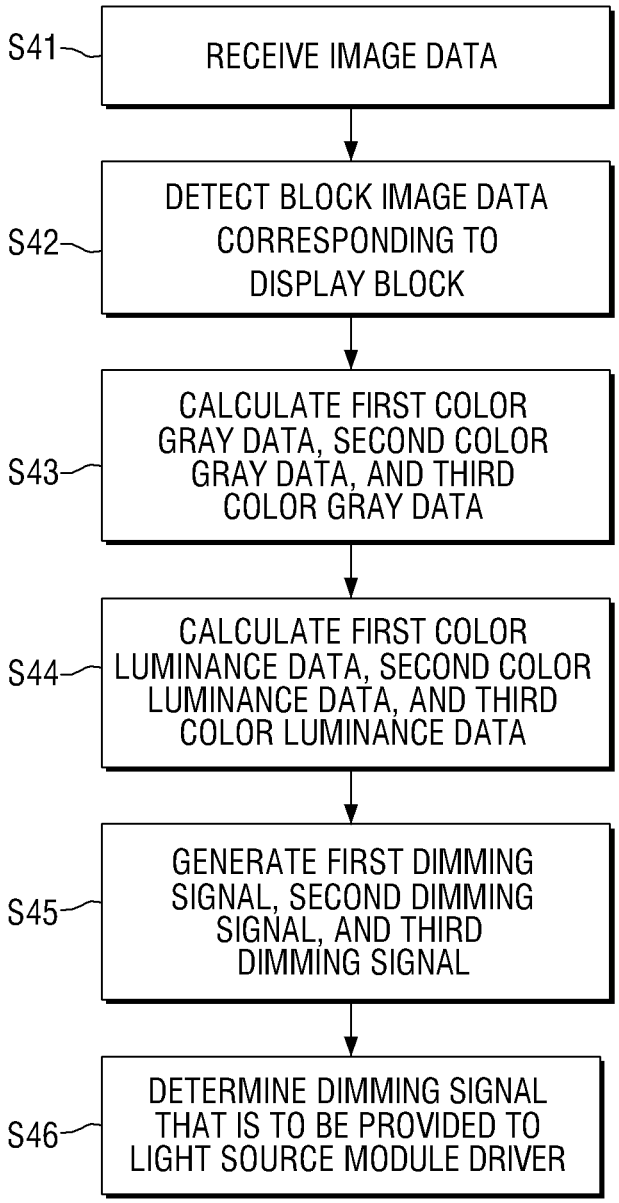
FIGS. 15 and 16 are flowcharts schematically illustrating an exemplary embodiment of the operation of a dimming controller of FIG. 11 according to the invention.
Figure 16:
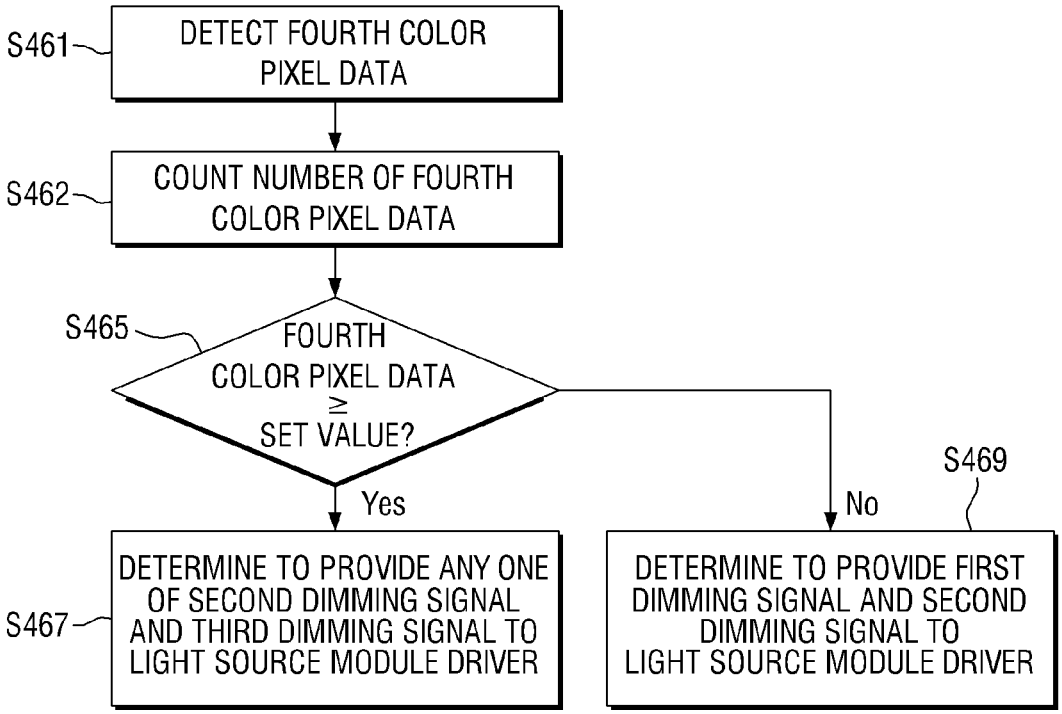
Figure 17:
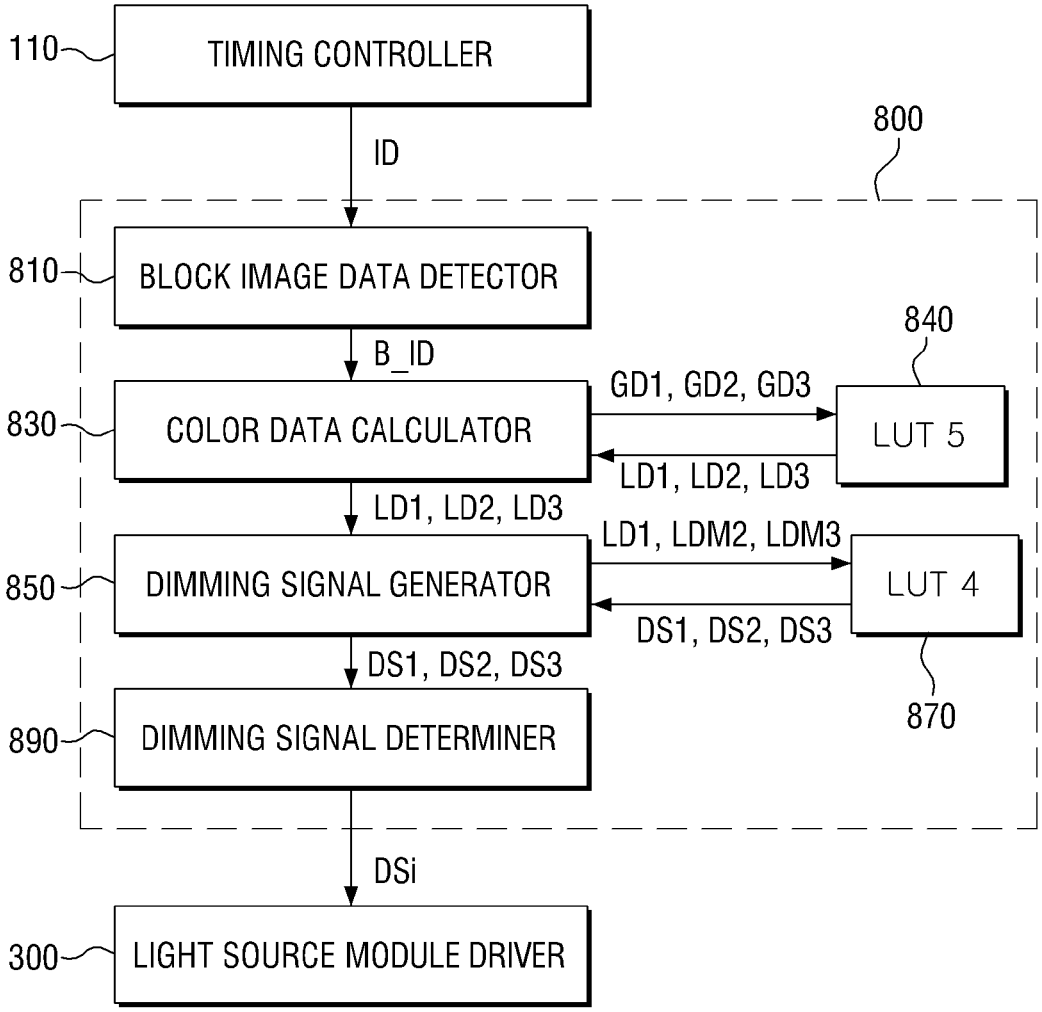
FIG. 17 is a schematic block diagram of an exemplary embodiment of the dimming controller of FIG. 11.

FIGS. 15 and 16 are flowcharts schematically illustrating the operation of the dimming controller 800 of FIG. 11 according to an exemplary embodiment of the invention. FIG. 17 is a schematic block diagram of an exemplary embodiment of the dimming controller 800 of FIG. 11.

Referring to FIGS. 11 through 17, the dimming controller 800 according to the illustrated exemplary embodiment may receive image data (operation S41), detect block image data corresponding to each display block from the received image data (operation S42), calculate first color gray data, second color gray data, and third color gray data based on the detected block image data (operation S43), calculate first color luminance data, second color luminance data, and third color luminance data using the first color gray data, the second color gray data, and the third color gray data (operation S44), generate a first dimming signal, a second dimming signal, and a third dimming signal (operation S45), and determine a dimming signal that is to be provided to a light source module driver from among the first dimming signal, the second dimming signal, and the third dimming signal (operation S46).

The dimming controller 800 (refers to FIG. 17) performing the above operations may include a block image data detector 810, a color data calculator 830, a dimming signal generator 850 and a dimming signal determiner 890 and may further include a fourth LUT 870 and a fifth LUT 840.

The receiving of the image data (operation S41) and the detecting of the block image data corresponding to each display block from the received image data (operation S42) may be performed by the block image data detector 810. More specifically, when the block image data detector 810 of the dimming controller 800 receives image data ID from the timing controller 110, it may divide the screen of the display panel 100 into a plurality of display blocks DB based on the received image data ID and detect block image data B_ID corresponding to each of the display blocks DB.

The calculating of the first color gray data, the second color gray data and the third color gray data based on the detected block image data (operation S43) and the calculating of the first color luminance data, the second color luminance data and the third color luminance data based on the first color gray data, the second color gray data and the third color gray data (operation S44) may be performed by the color data calculator 830. More specifically, the color data calculator 830 calculates gray data of each color by using the block image data B_ID detected by the block image data detector 810. The gray data of each color may be first color gray data GD1, second color gray data GD2, and third color gray data GD3. In an exemplary embodiment, the first color, the second color, and the third color may be, but are not limited to, red, blue, and green, respectively. The first color gray data GD1, the second color gray data GD2 and the third color gray data GD3 have already been described above in detail with reference to FIGS. 6 and 7.

In an exemplary embodiment, each gray data GD1, GD2 or GD3 may be average gray data of a display block DB for each color. However, the invention is not limited thereto, and each gray data GD1, GD2 or GD3 may be any one of corrected gray data determined for each color by calculating at least one of a variance, a standard deviation, a skewness, a kurtosis, a central moment, and an image moment using maximum gray data of a display block DB for each color, minimum gray data of the display block DB for each color, median gray data of the display block DB for each color, mode gray data of the display block DB for each color, and average gray data of the display block DB for each color, for example.

The color data calculator 830 may calculate first color luminance data LD1, second color luminance data LD2, and third color luminance data LD3 based on the first color gray data GD1, the second color gray data GD2, and the third color gray data GD3.

In an exemplary embodiment, the color data calculator 830 may calculate the first color luminance data LD1, the second color luminance data LD2, and the third color luminance data LD3 using the fifth LUT 840 which stores a luminance level corresponding to a gray level of each color. That is, the color data calculator 830 may extract the first color luminance data LD1, the second color luminance data LD2 and the third color luminance data LD3 respectively corresponding to the first color gray data GD1, the second color gray data GD2 and the third color gray data GD3 from the fifth LUT 840.

The generating of the first dimming signal, the second dimming signal, and the third dimming signal based on the first color luminance data, the second color luminance data, and the third color luminance data (operation S45) may be performed by the dimming signal generator 850. The dimming signal generator 850 may generate a first dimming signal DS1, a second dimming signal DS2, and a third dimming signal DS3 which determine a dimming duty cycle of each of the first light sources 610, a dimming duty cycle of each of the second light sources 630, and a dimming duty cycle of each of the third light sources 650 in the light source module 600. More specifically, the dimming signal generator 850 generates the first dimming signal DS1 for the first light sources 610 which emit light of the first color (e.g., green light) based on the first color luminance data LD1 received from the color data calculator 830. At the same or different time, the dimming signal generator 850 generates the second dimming signal DS2 for the second light sources 630 which emit a combination (e.g., magenta light) of light of the second color (e.g., blue light) and light of the third color (e.g., red light) based on the second color luminance data LD2 and the third color luminance data LD3 received from the color data calculator 830. In addition, the dimming signal generator 850 generates the third dimming signal DS3 for the third light sources 650 which emit light (e.g., magenta light) of the fourth color which is a combination of light of the first color (e.g., green light) and light of the second color (e.g., blue light) based on the first color luminance data LD1 and the second color luminance data LD2 received from the color data calculator 830.

In an exemplary embodiment, the dimming signal generator 850 may generate the first dimming signal DS1, the second dimming signal DS2, and the third dimming signal DS3 using the fourth LUT 870 which stores a dimming duty cycle corresponding to a luminance level of each color. That is, the dimming signal generator 850 may extract a dimming duty cycle corresponding to the first color luminance data LD1 from the fourth LUT 870 and generate the first dimming signal DS1 based on the extracted dimming duty cycle. In addition, the dimming signal generator 850 may generate mixed color luminance data LDM2 based on the second color luminance data LD2 and the third color luminance data LD3, extract a dimming duty cycle corresponding to the mixed color luminance data LDM2 from the fourth LUT 870, and generate the second dimming signal DS2 based on the extracted dimming duty cycle. Further, the dimming signal generator 850 may generate mixed color luminance data LDM3 based on the first color luminance data LD1 and the second color luminance data LD2, extract a dimming duty cycle corresponding to the mixed color luminance data LDM3 from the fourth LUT 870, and generate the third dimming signal DS3 based on the extracted dimming duty cycle. Here, the mixed color luminance data LDM2 may be average data of the second color luminance data LD2 and the third color luminance data LD3. However, the invention is not limited thereto, and the mixed color luminance data LDM2 may be weighted average data of the second color luminance data LD2 and the third color luminance data LD3. Likewise, the mixed color luminance data LDM3 may be, but is not limited to, average data of the first color luminance data LD1 and the second color luminance data LD2.

Referring to FIGS. 15 to 17, the determining of the dimming signal that is to be provided to the light source module driver from among the first dimming signal, the second dimming signal, and the third dimming signal (operation S46) may be performed by the dimming signal determiner 890. The determining of the dimming signal (operation S46) may include detecting fourth color pixel data (operation S461), counting the detected fourth color pixel data (operation S462), determining to provide at least any one of the second dimming signal and the third dimming signal to the light source module driver when the counted number of the fourth color pixel data is equal to or greater than a preset value (operations S465 and S467), and determining to provide the first dimming signal and the second dimming signal to the light source module driver when the counted number of the fourth color pixel data is less than the preset value (operations S465 and S469).

That is, the dimming signal determiner 890 may determine a dimming signal DSi that is to be provided to the light source module driver 300 from among the first dimming signal DS1, the second dimming signal DS2, and the third dimming signal DS3 generated by the dimming signal generator 850, and the light source module driver 300 may drive light sources, which correspond to the dimming signal DSi received from the dimming signal determiner 890, from among the first through third light sources 610 through 650.

The dimming signal determiner 890 may obtain pixel gray data, which corresponds to each pixel of a display block DB, from block image data B_ID and determine the dimming signal DSi that is to be provided to the light source module driver 300 based on the obtained pixel gray data. In an exemplary embodiment, the dimming signal determiner 890 obtains pixel gray data, which corresponds to each pixel of a display block DB, from the block image data B_ID. Then, the dimming signal determiner 890 detects fourth color pixel data from the pixel gray data. In an exemplary embodiment, assuming that an RGB gray value of the pixel gray data is (Rd, Gd, Bd), pixel gray data satisfying the condition that an absolute value of a difference (Gd−Bd) between Gd and Bd is equal to or greater than a preset value (e.g., a first set value) and that a value of Rd is less than a preset value (e.g., a second set value) is detected as the fourth color (e.g., cyan) pixel data. That is, the dimming signal determiner 890 may detect pixel gray data which satisfies a preset cyan grayscale range as the fourth color pixel data.

Then, the dimming signal determiner 890 counts the number of the fourth color pixel data. When the counted number of the fourth color pixel data is equal to or greater than a preset value (e.g., a third set value), the dimming signal determiner 890 provides at least any one of the second dimming signal DS2 and the third dimming signal DS3 to the light source module driver 300. In an exemplary embodiment, the third set value may be half the number of pixels P located in a display block DB. In an exemplary embodiment, when the number of pixels P located in one display block DB is 5000, the third set value may be 2500, for example. However, this is merely an exemplary embodiment, and the third set value can be changed as desired. The dimming signal determiner 890 may provide both the second dimming signal DS2 and the third dimming signal DS3 to the light source module driver 300 or may provide only the third dimming signal DS3 to the light source module driver 300. When both the second dimming signal DS2 and the third dimming signal DS3 are provided to the light source module driver 300, the light source module driver 300 drives only the second light sources 630 and third light sources 650 and does not drive the first light source 610. In the exemplary embodiment, when only the third dimming signal DS3 is provided to the light source module driver 300, the light source module driver 300 drives only the third light sources 650 and does not drive the first light sources 610 and the second light sources 630.

When the counted number of the fourth color pixel data is less than the preset value (e.g., the third set value), the dimming signal determiner 890 may provide the first dimming signal DS1 and the second dimming signal DS2 to the light source module driver 300. Accordingly, the light source module driver 300 may drive only the first light sources 610 and the second light sources 630 and do not drive the third light sources 650.

Figure 18:
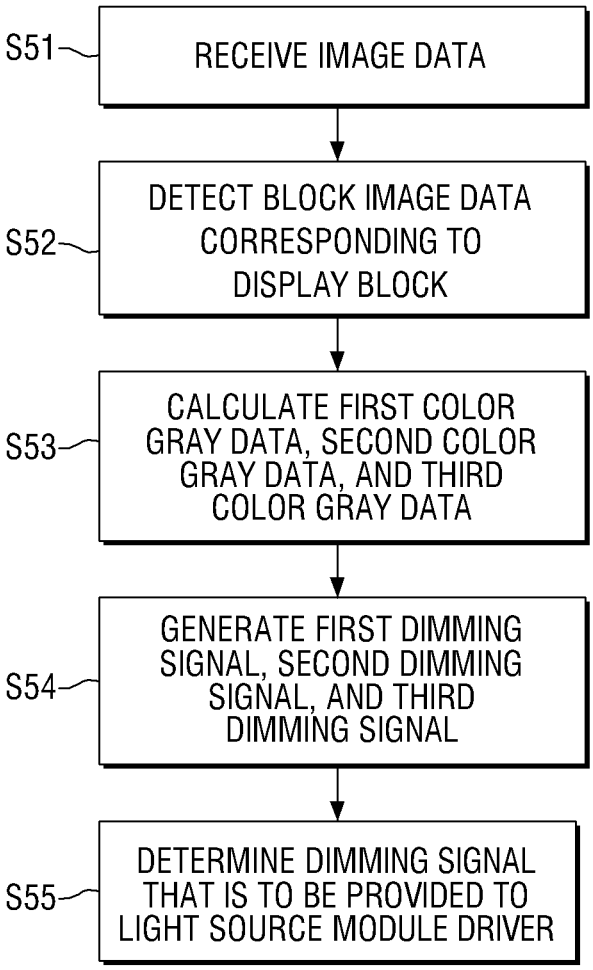
FIG. 18 is a flowchart schematically illustrating another embodiment of the operation of the dimming controller of FIG. 11 according to the invention.
Figure 19:
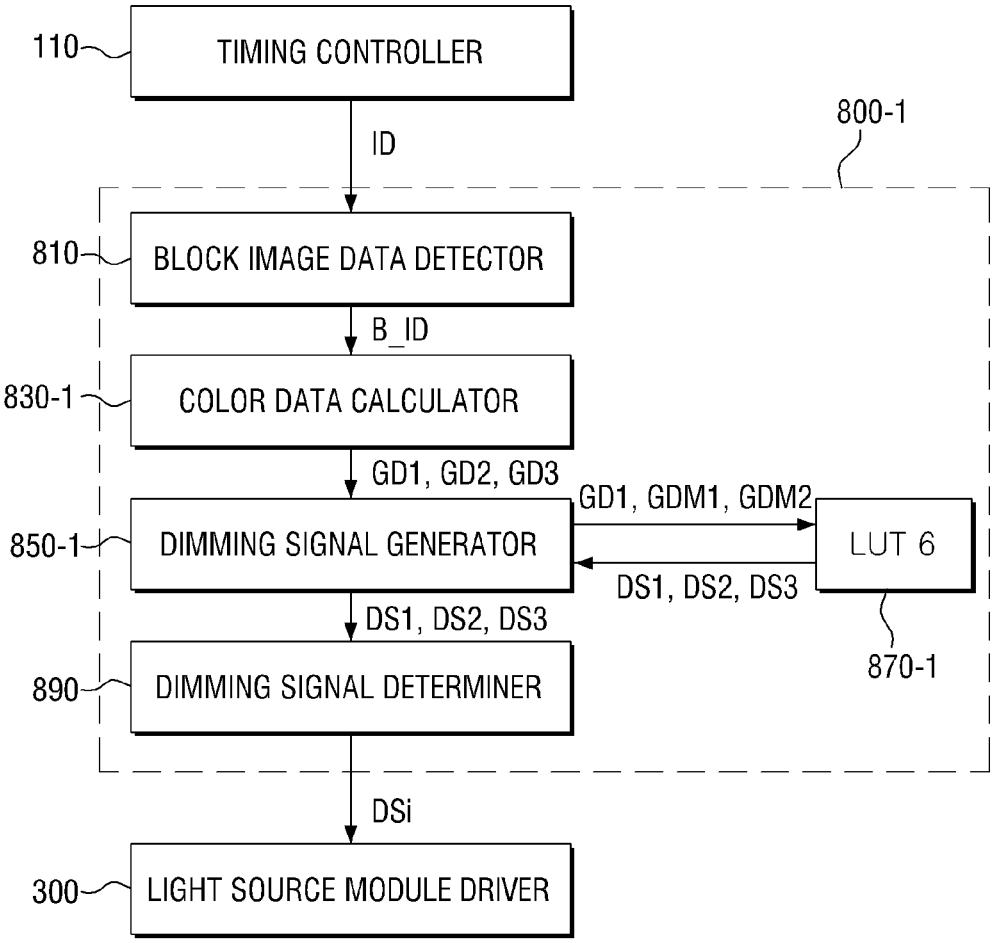
FIG. 19 is a schematic block diagram of another embodiment of the dimming controller of FIG. 11.

FIG. 18 is a flowchart schematically illustrating the operation of the dimming controller 800 of FIG. 11 according to another embodiment of the invention. FIG. 19 is a schematic block diagram of another embodiment of the dimming controller 800 of FIG. 11.

Referring to FIGS. 11 through 14, 18 and 19, a dimming controller 800-1 according to the illustrated exemplary embodiment may receive image data (operation S51), detect block image data corresponding to each display block from the received image data (operation S52), calculate first color gray data, second color gray data, and third color gray data based on the detected block image data (operation S53), generate a first dimming signal, a second dimming signal, and a third dimming signal based on the first color gray data, the second color gray data, and the third color gray data (operation S54), and determine a dimming signal that is to be provided to a light source module driver from among the first dimming signal, the second dimming signal, and the third dimming signal (operation S55).

The dimming controller 800-1 performing the above operations may include a block image data detector 810, a color data calculator 830-1, a dimming signal generator 850-1 and a dimming signal determiner 890 and may further include a sixth LUT 870-1. That is, the dimming controller 800-1 according to the illustrated exemplary embodiment is different from the dimming controller 800 described above with reference to FIGS. 15 through 17 in that it includes the sixth LUT 870-1 and that the color data calculator 830-1 and the dimming signal generator 850-1 operate differently from the color data calculator 830 and the dimming signal generator 850 of the dimming controller 800. Other elements and operations are the same as those described above with reference to FIGS. 15 through 17, and thus a redundant description thereof will be given briefly or omitted for the sake of simplicity.

The receiving of the image data (operation S51) and the detecting of the block image data corresponding to each display block from the received image data (operation S52) may be performed by the block image data detector 810.

The calculating of the first color gray data, the second color gray data and the third color gray data based on the detected block image data (operation S53) may be performed by the color data calculator 830-1. More specifically, the color data calculator 830-1 calculates gray data of each color by using block image data B_ID detected by the block image data detector 810. The gray data of each color may be first color gray data GD1, second color gray data GD2, and third color gray data GD3. The first color, the second color, and the third color may be, but are not limited to, red, blue, and green, respectively, for example. The first color gray data GD1, the second color gray data GD2 and the third color gray data GD3 have already been described above in detail with reference to FIG. 8.

The generating of the first dimming signal, the second dimming signal, and the third dimming signal based on the first color gray data, the second color gray data, and the third color gray data (operation S54) may be performed by the dimming signal generator 850-1. The dimming signal generator 850-1 may generate a first dimming signal DS1 using the first color gray data GD1. In addition, the dimming signal generator 850-1 may generate a second dimming signal DS2 based on the second color gray data GD2 and the third color gray data GD3 and generate a third dimming signal DS3 based on the first color gray data GD1 and the second color gray data GD2.

In an exemplary embodiment, the dimming signal generator 850-1 may generate the first dimming signal DS1, the second dimming signal DS2, and the third dimming signal DS3 using the sixth LUT 870-1 which stores a dimming duty cycle corresponding to a luminance level of each color. That is, the dimming signal generator 850-1 may extract a dimming duty cycle corresponding to the first color gray data GD1 from the sixth LUT 870-1 and generate the first dimming signal DS1 based on the extracted dimming duty cycle. In addition, the dimming signal generator 850-1 may generate mixed color gray data GDM1 based on the second color gray data GD2 and the third color gray data GD3, extract a dimming duty cycle corresponding to the mixed color gray data GDM1 from the sixth LUT 870-1, and generate the second dimming signal DS2 based on the extracted dimming duty cycle. Further, the dimming signal generator 850-1 may generate mixed color gray data GDM2 based on the first color gray data GD1 and the second color gray data GD2, extract a dimming duty cycle corresponding to the mixed color gray data GDM2 from the sixth LUT 870-1, and generate the third dimming signal DS3 based on the extracted dimming duty cycle. Here, the mixed color gray data GDM2 may be, but is not limited to, average data of the second color gray data GD2 and the third color gray data GD3. Likewise, the mixed color gray data GDM2 may be, but is not limited to, average data of the first color gray data GD1 and the second color gray data GD2.

The determining of the dimming signal that is to be provided to the light source module driver from among the first dimming signal, the second dimming signal, and the third dimming signal (operation S55) may be performed by the dimming signal determiner 890. The operation of the dimming signal determiner 890 is the same as that of the dimming signal determiner 890 described above with reference to FIGS. 15 through 17, and thus a description thereof will be omitted.

Figure 20:
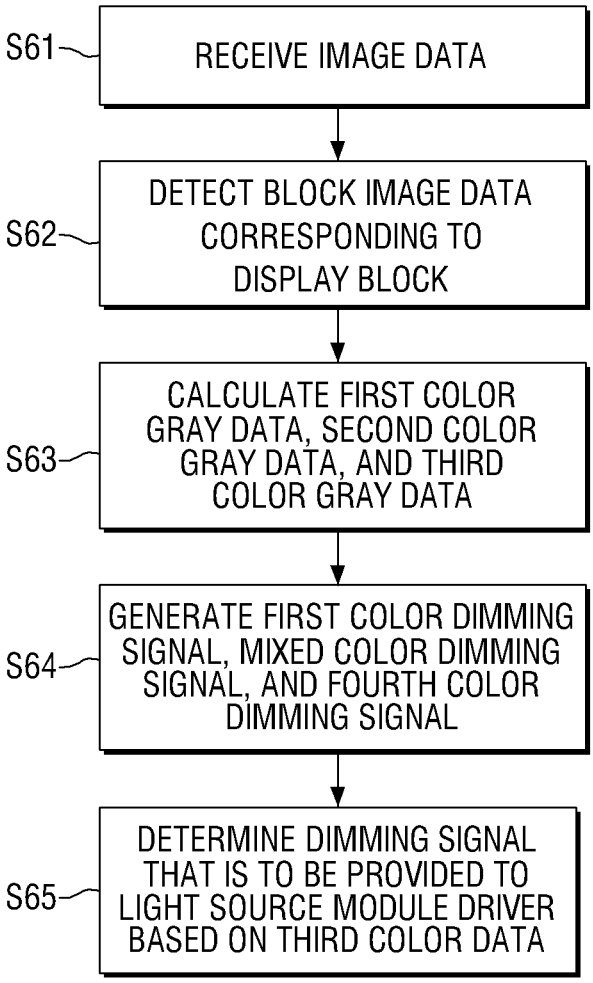
FIGS. 20 and 21 are flowcharts schematically illustrating another embodiment of the operation of the dimming controller of FIG. 11 according to the invention.
Figure 21:
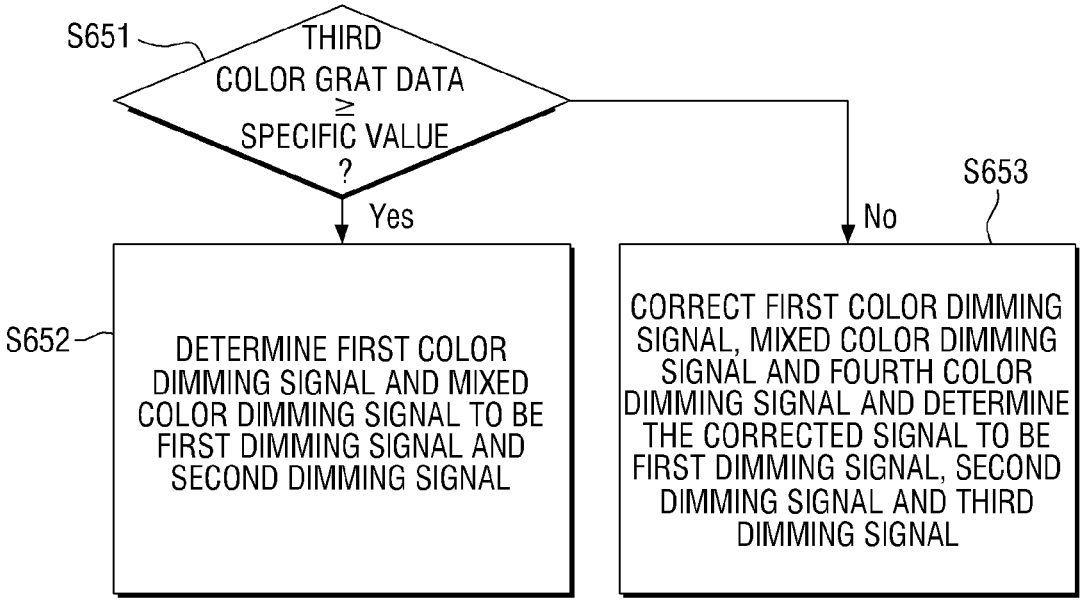
Figure 22:
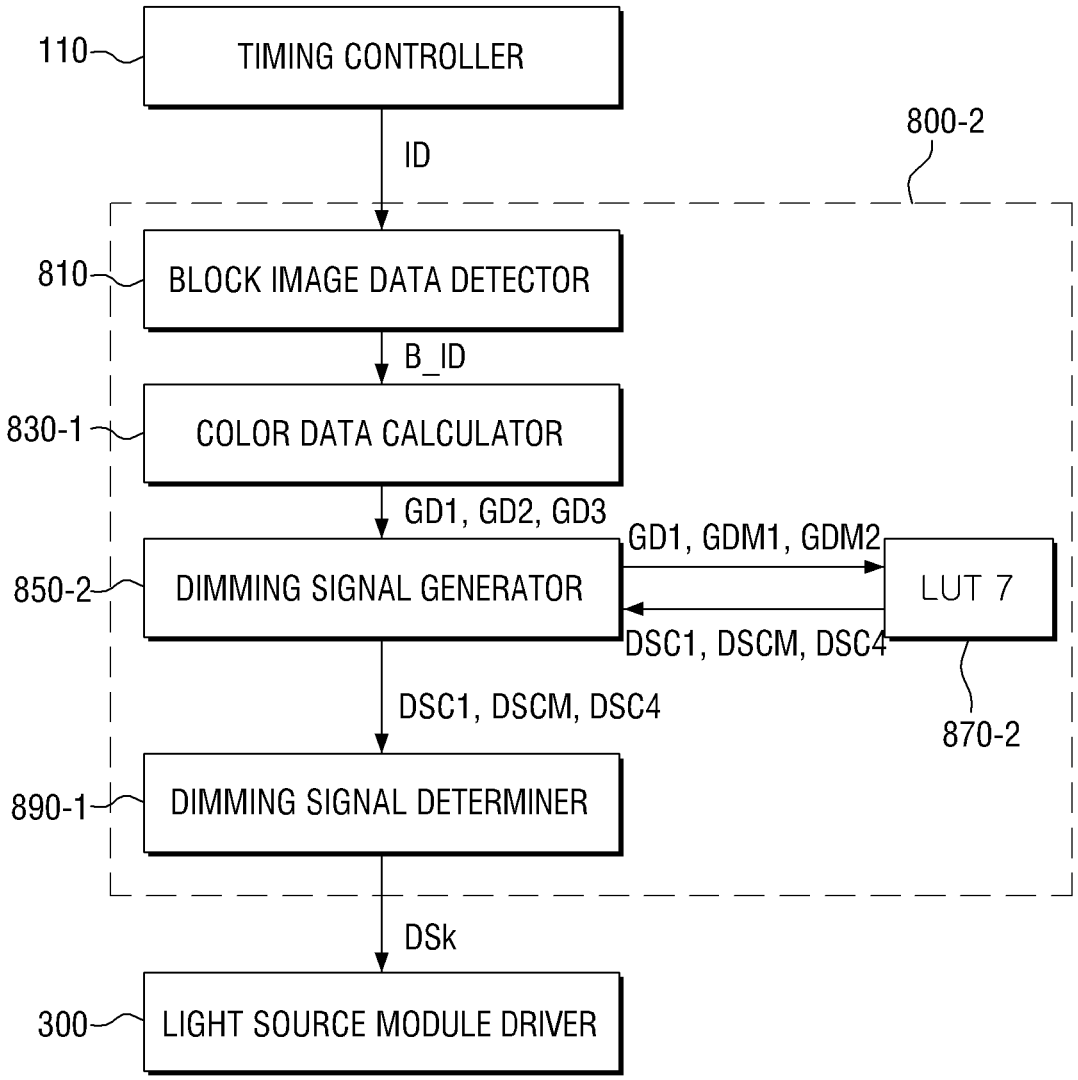
FIG. 22 is a schematic block diagram of another embodiment of the dimming controller of FIG. 11.

FIGS. 20 and 21 are flowcharts schematically illustrating the operation of the dimming controller 800 of FIG. 11 according to another embodiment of the invention. FIG. 22 is a schematic block diagram of another embodiment of the dimming controller 800 of FIG. 11.

Referring to FIGS. 11 through 14 and 20 through 22, a dimming controller 800-2 according to the illustrated exemplary embodiment may receive image data (operation S61), detect block image data corresponding to each display block from the received image data (operation S62), calculate first color gray data, second color gray data, and third color gray data based on the detected block image data (operation S63), generate a first color dimming signal, a mixed color (of a second color and a third color) dimming signal, and a fourth color dimming signal using the first color gray data, the second color gray data, and the third color gray data (operation S64), and determine a dimming signal that is to be provided to a light source module driver based on the third color gray data (operation S65).

The dimming controller 800-2 (refers to FIG. 22) performing the above operations may include a block image data detector 810, a color data calculator 830-1, a dimming signal generator 850-2 and a dimming signal determiner 890-1 and may further include a seventh LUT 870-2.

That is, the dimming controller 800-2 according to the illustrated exemplary embodiment is different from the dimming controller 800 described above with reference to FIGS. 15 through 17 in that it includes the seventh LUT 870-2 and that the color data calculator 830-1 and the dimming signal generator 850-2 operate differently from the color data calculator 830 and the dimming signal generator 850 of the dimming controller 800. Other elements and operations are the same as those described above with reference to FIGS. 15 through 17, and thus a redundant description thereof will be given briefly or omitted for the sake of simplicity.

The receiving of the image data (operation S61) and the detecting of the block image data corresponding to each display block from the received image data (operation S62) may be performed by the block image data detector 810.

The calculating of the first color gray data, the second color gray data and the third color gray data based on the detected block image data (operation S63) may be performed by the color data calculator 830-1. The operation of the color data calculator 830-1 is the same as that of the color data calculator 830 described above with reference to FIGS. 18 and 19, and thus a description thereof will be omitted.

The generating of the first color dimming signal, the mixed color dimming signal, and the fourth color dimming signal using the first color gray data, the second color gray data, and the third color gray data (operation S64) may be performed by the dimming signal generator 850-2. The dimming signal generator 850-2 may generate a first color dimming signal DSC1 using the first color gray data GD1. In addition, the dimming signal generator 850-2 may generate a mixed color dimming signal DSCM based on the second color gray data GD2 and the third color gray data GD3 and generate a fourth color dimming signal DSC4 based on the first color gray data GD1 and the second color gray data GD2.

In an exemplary embodiment, the dimming signal generator 850-2 may generate the first color dimming signal DSC1, the mixed color dimming signal DSCM, and the fourth color dimming signal DSC4 using the seventh LUT 870-2 which stores a dimming duty cycle corresponding to a gray level of each color. That is, the dimming signal generator 850-2 may extract a dimming duty cycle corresponding to the first color gray data GD1 from the seventh LUT 870-2 and generate the first color dimming signal DSC1 based on the extracted dimming duty cycle. In addition, the dimming signal generator 850-2 may generate mixed color gray data GDM1 based on the second color gray data GD2 and the third color gray data GD3, extract a dimming duty cycle corresponding to the mixed color gray data GDM1 from the seventh LUT 870-2, and generate the mixed color dimming signal DSCM based on the extracted dimming duty cycle. Further, the dimming signal generator 850-2 may generate mixed color gray data GDM2 based on the first color gray data GD1 and the second color gray data GD2, extract a dimming duty cycle corresponding to the mixed color gray data GDM2 from the seventh LUT 870-2, and generate the fourth color dimming signal DSC4 based on the extracted dimming duty cycle. Here, the mixed color gray data GDM1 may be, but is not limited to, average data of the second color gray data GD2 and the third color gray data GD3. Likewise, the mixed color gray data GDM2 may be, but is not limited to, average data of the first color gray data GD1 and the second color gray data GD2.

The determining of the dimming signal that is to be provided to the light source module driver based on the third color gray data (operation S65) may be performed by the dimming signal determiner 890-1.

The determining of the dimming signal (operation S65) may include determining whether the third color gray data is equal to or greater than a preset value (e.g., a fourth set value) (operation S651) (refers to FIG. 21), determining the first color dimming signal and the mixed color dimming signal to be a first dimming signal and a second dimming signal when determining that the third color gray data is equal to or greater than the fourth set value (operation S652), and correcting the first color dimming signal, the mixed color dimming signal and the fourth color dimming signal and determining the corrected first color dimming signal, the corrected mixed color dimming signal and the corrected fourth color dimming signal to be a first dimming signal, a second dimming signal and a third dimming signal when determining that the third color gray data is less than the third set value (operation S653).

The dimming signal determiner 890-1 receives the third color gray data GD3 from the dimming signal generator 850-2 or the color data calculator 830-1 and determines whether the third color gray data GD3 is equal to or greater than a preset value (e.g., a fourth set value). When determining that the third color gray data GD3 is equal to or greater than the fourth set value (for example, a case where the third color gray data GD3 has a value of 100 in a range of 0 to 255, and the fourth set value is 70), the dimming signal determiner 890-1 determines the first color dimming signal DSC1 and the mixed color dimming signal DSCM to be a first dimming signal DS1 and a second dimming signal DS2 and provides the first dimming signal DS1 and the second dimming signal DS2 to the light source module driver 300. In response to the first dimming signal DS1 and the second dimming signal DS2, the light source module driver 300 may drive the first light sources 610 and the second light sources 630, and may not drive the third light sources 650.

When determining that the third color gray data GD3 is less than the fourth set value (for example, a case where the third color gray data GD3 has a value of 50 in the range of 0 to 255, and the fourth set value is 70), the dimming signal determiner 890-1 multiplies the first color dimming signal DSC1 by a specific value (hereinafter, referred to as a first value) and determines the multiplication result to be the first dimming signal DS1. Likewise, the dimming signal determiner 890-1 multiplies the mixed dimming signal DSCM by a specific value (hereinafter, referred to as a second value) and determines the multiplication result to be the second dimming signal DS2. Also, the dimming signal determiner 890-1 multiplies the fourth color dimming signal DSC4 by a specific value (hereinafter, referred to as a third value) and determines the multiplication result to be the third dimming signal DS3. Then, the dimming signal determiner 890-1 provides the first dimming signal DS1, the second dimming signal DS2, and the third dimming signal DS3 to the light source module driver 300. The light source module driver 300 may drive the first through third light sources 610 through 650 in response to the first through third dimming signals DS1 through DS3.

The first value, the second value, and the third value may be values based on the first color gray data GD1, the second color gray data GD2, and the third color gray data GD3. In an exemplary embodiment, the first color gray data GD1, the second color gray data GD2, and the third color gray data GD3 may respectively have values of gd1, gd2, and gd3 as gray values in the range of 0 to 255. Assuming that an absolute value of a difference between gd1 and gd2 is Agd, the first value may be Agd/255. In addition, the second value may be Agd/255 which is equal to the first value, and the third value may be (255−Agd)/255. However, this is merely an exemplary embodiment, and the first through third values can be changed as desired.

Figure 23:
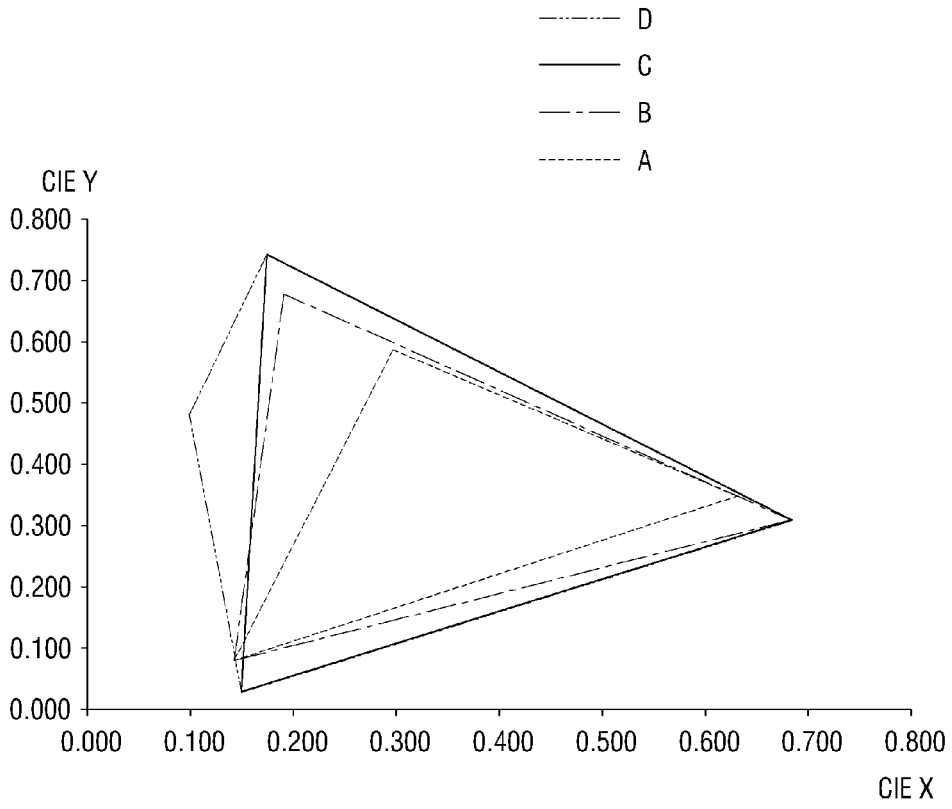
FIG. 23 illustrates another embodiment of color coordinates representing the color reproducibility of an image realized on a display device according to the invention.

FIG. 23 illustrates CIE color coordinates representing the color reproducibility of an image realized on a display device according to another embodiment of the invention. More specifically, 'A' represents color coordinates of an image realized on a display device (hereinafter, referred to as 'display device A') which includes red, green and blue LEDs, 'B' represents color coordinates of an image realized on a display device (hereinafter, referred to as 'display device B') which includes first light sources, each having a green LED, and second light sources, each having a blue LED and a red phosphor, and does not perform dimming driving, 'C' represents color coordinates of an image realized on a display device (hereinafter, referred to as 'display device C') according to an exemplary embodiment of the invention which includes first light sources, each having a green LED, and second light sources, each having a blue LED and a red phosphor, and performs dimming driving, and 'D' represents color coordinates of an image realized on a display device according to another embodiment of the invention which includes first light sources, each having a green LED, second light sources, each having a blue LED and a red phosphor, and third light sources, each having a cyan LED.

Referring to FIG. 23, the area of a triangle A of display device A is smaller than the area of a triangle B of display device B, and the area of a triangle C of display device C is greater than those of the triangles A and B. In addition, the area of a color space D of the display device according to another embodiment of the invention is greater than those of the triangles A, B and C.

That is, according to the current embodiment, among a plurality of light sources, light sources not necessary for realizing an image are turned off, or the amount of current supplied to these light sources is reduced. Therefore, the power consumption of a display device can be reduced. In addition, a display device having further improved color reproducibility can be provided.

The exemplary embodiments of the invention provide at least one of the following advantages.

The exemplary embodiments of the invention can provide a display device having improved display quality.

The exemplary embodiments of the invention can also provide a display device having improved color reproducibility and reduced power consumption.

However, the effects of the invention are not restricted to the one set forth herein. The above and other effects of the invention will become more apparent to one of ordinary skill in the art to which the invention pertains by referencing the claims.

While the invention has been particularly shown and described with reference to exemplary embodiments thereof, it will be understood by those of ordinary skill in the art that various changes in form and detail may be made therein without departing from the spirit and scope of the invention as defined by the following claims. The exemplary embodiments should be considered in a descriptive sense only and not for purposes of limitation.

What is claimed is:

1. A display device comprising:

a display panel which displays an image corresponding to input image data and is divided into a plurality of display blocks;

a light source module which comprises a plurality of light source blocks respectively corresponding to the plurality of display blocks, each of the plurality of light source blocks comprising:

a first light source which emits light of a first color; and a second light source which emits light of a combination of a second color and a third color;

a dimming controller which outputs a dimming signal which adjusts a dimming duty cycle of each of the plurality of light source blocks based on the image data;

a light source module driver which drives each of the plurality of light source blocks based on the dimming signal, wherein the dimming controller detects block image data corresponding to each of the plurality of display blocks from the image data, calculates color data based on the block image data, and provides a first dimming signal generated for the first light source based on the color data and a second dimming signal generated for the second light source based on the color data to the light source module driver.

2. The display device of claim 1, wherein the dimming controller comprises:

a block image data detector which detects the block image data from the image data;

a color data calculator which calculates first color luminance data, second color luminance data, and third color luminance data based on the block image data; and a dimming signal generator which generates the first dimming signal based on the first color luminance data and generates the second dimming signal based on the second color luminance data and the third color luminance data.

3. The display device of claim 2, further comprising a first lookup table which stores a dimming duty cycle corresponding to luminance data, wherein the dimming signal generator generates the first dimming signal and the second dimming signal based on the first lookup table.

4. The display device of claim 2, further comprising a second lookup table which stores luminance data corresponding to gray data, wherein the color data calculator calculates first color gray data, second color gray data, and third color gray data based on the block image data and calculates the first color luminance data, the second color luminance data, and the third color luminance data respectively corresponding to the first color gray data, the second color gray data, and the third color gray data based on the second lookup table.

5. The display device of claim 1, wherein the dimming controller comprises:

a block image data detector which detects the block image data from the image data;

a color data calculator which calculates first color gray data, second color gray data, and third color gray data based on the block image data;

a dimming signal generator which generates a first color dimming signal based on the first color gray data, generates a second color dimming signal based on the second color gray data, and generates a third color dimming signal based on the third color gray data; and a dimming signal determiner which determines the first color dimming signal to be the first dimming signal and determines the second dimming signal based on the second color dimming signal and the third color dimming signal.

6. The display device of claim 5, further comprising a third lookup table which stores a dimming duty cycle corresponding to gray data, wherein the dimming signal generator generates the first color dimming signal, the second color dimming signal, and the third color dimming signal based on the third lookup table.

7. The display device of claim 1, wherein the first light source comprises a first color light-emitting diode which emits light of the first color, and the second light source comprises a second color light-emitting diode which emits light of the second color, and a phosphor of a third color which is located on the second color light-emitting diode.

8. The display device of claim 1, wherein the first color, the second color, and the third color are different from each other.

9. The display device of claim 1, wherein the first color is green, the second color is blue, and the third color is red.

10. A display device comprising:

a light source module which comprises a plurality of light source blocks, each of the plurality of light source blocks comprising:

a first light source which emits light of a first color;

a second light source which emits light of a combination of a second color and a third color; and a third light source which emits light of a fourth color;

a display panel which displays an image and is divided into a plurality of display blocks respectively corresponding to the plurality of light source blocks;

a dimming controller which outputs a dimming signal which adjusts a dimming duty cycle of each of the plurality of light source blocks based on image data of the plurality of display blocks; and a light source module driver which drives each of the plurality of light source blocks based on the dimming signal, wherein the dimming controller detects block image data corresponding to each of the plurality of display blocks from the image data, calculates color data based on the image data of the plurality of display blocks, and provides at least one of a first dimming signal generated for the first light source based on the color data, a second dimming signal generated for the second light source based on the color data, and a third dimming signal generated for the third light source based on the color data to the light source module driver.

11. The display device of claim 10, wherein the dimming controller comprises:

a block image data detector which detects the block image data from the image data;

a color data calculator which calculates first color luminance data, second color luminance data, and third color luminance data based on the block image data;

a dimming signal generator which generates the first dimming signal based on the first color luminance data, generates the second dimming signal based on the second color luminance data and the third color luminance data, and generates the third dimming signal based on the first color luminance data and the second color luminance data; and a dimming signal determiner which determines the dimming signal which is to be provided to the light source module driver from among the first through third dimming signals.

12. The display device of claim 11, further comprising a fourth lookup table which stores luminance data corresponding to gray data, wherein the color data calculator calculates first color gray data, second color gray data, and third color gray data based on the image data of the plurality of display blocks and calculates the first color luminance data, the second color luminance data, and the third color luminance data respectively corresponding to the first color gray data, the second color gray data, and the third color gray data based on the fourth lookup table.

13. The display device of claim 11, further comprising a fifth lookup table which stores a dimming duty cycle corresponding to luminance data, wherein the dimming signal generator generates the first dimming signal, the second dimming signal and the third dimming signal based on the fifth lookup table.

14. The display device of claim 11, wherein the dimming signal determiner detects fourth color pixel data from the block image data, counts a number of the detected fourth color pixel data, and determines the dimming signal which is to be provided to the light source module driver based on the counted number of the fourth color pixel data.

15. The display device of claim 14, wherein the dimming signal determiner determines to provide at least one of the second dimming signal and the third dimming signal to the light source module driver when the number of the fourth color pixel data is equal to or greater than a preset value and determines to provide the first dimming signal and the second dimming signal to the light source module driver when the number of the fourth pixel data is less than the preset value.

16. The display device of claim 10, wherein the dimming controller comprises:

a block image data detector which detects the block image data from the image data;

a color data calculator which calculates first color gray data, second color gray data, and third color gray data based on the block image data;

a dimming signal generator which generates the first dimming signal based on the first color gray data, generates the second dimming signal based on the second color gray data and the third color gray data, and generates the third dimming signal based on the first color gray data and the second color gray data; and a dimming signal determiner which determines the dimming signal which is to be provided to the light source module driver from among the first through third dimming signals.

17. The display device of claim 16, further comprising a sixth lookup table which stores a dimming duty cycle corresponding to gray data, wherein the dimming signal generator generates the first dimming signal, the second dimming signal and the third dimming signal based on the sixth lookup table.

18. The display device of claim 16, wherein the dimming signal determiner detects fourth color pixel data from the block image data, counts a number of the detected fourth color pixel data, and determines the dimming signal which is to be provided to the light source module driver based on the counted number of the fourth color pixel data.

19. The display device of claim 18, wherein the dimming signal determiner determines to provide at least one of the second dimming signal and the third dimming signal to the light source module driver when the number of the fourth color pixel data is equal to or greater than a preset value and determines to provide the first dimming signal and the second dimming signal to the light source module driver when the number of the fourth pixel data is less than the preset value.

20. The display device of claim 10, wherein the dimming controller comprises:

a block image data detector which detects the block image data from the image data;

a color data calculator which calculates first color gray data, second color gray data, and third color gray data based on the block image data;

a dimming signal generator which generates a first color dimming signal based on the first color gray data, generates a mixed color dimming signal based on the second color gray data and the third color gray data, and generates a fourth color dimming signal based on the first color gray data and the second color gray data; and a dimming signal determiner which determines a dimming signal which is to be provided to the light source module driver from among the first through third dimming signals based on the third color gray data.

21. The display device of claim 20, further comprising a seventh lookup table which stores a dimming duty cycle corresponding to gray data, wherein the dimming signal generator generates the first color dimming signal, the mixed color dimming signal and the fourth color dimming signal based on the seventh lookup table.

22. The display device of claim 20, wherein the dimming signal determiner determines the dimming signal which is to be provided to the light source module driver based on whether the third color gray data is equal to or greater than a preset value.

23. The display device of claim 22, wherein the dimming signal determiner determines the first color dimming signal and the mixed color dimming signal to be the first dimming signal and the second dimming signal when the third color gray data is equal to or greater than the preset value.

24. The display device of claim 22, wherein, when the third color gray data is less than the preset value, the dimming signal determiner corrects the first color dimming signal, the mixed color dimming signal and the fourth color dimming signal, and determines the corrected first color dimming signal, the corrected mixed color dimming signal and the corrected fourth color dimming signal to be the first dimming signal, the second dimming signal, and the third dimming signal.

25. The display device of claim 10, wherein the first light source comprises: a first color light-emitting diode which emits light of the first color, the second light source comprises a second color light-emitting diode which emits light of the second color, and a phosphor of the third color which is located on the second color light-emitting diode, and the third light source comprises a fourth color light-emitting diode which emits light of the fourth color.

26. The display device of claim 25, wherein the third light source further comprises a phosphor of a fifth color which is located on the fourth color light-emitting diode.

27. The display device of claim 26, wherein the fifth color is a complementary color to the fourth color.

28. The display device of claim 10, wherein the first color, the second color, the third color, and the fourth color are different from each other.

29. The display device of claim 28, wherein the first color is green, the second color is blue, the third color is red, and the fourth color is cyan.

* * * * *